US009063466B2

(12) United States Patent
Okubo et al.

(10) Patent No.: US 9,063,466 B2
(45) Date of Patent: Jun. 23, 2015

(54) DEVELOPING DEVICE HAVING AN ATTACHING UNIT FOR ATTACHING DEVELOPER AND IMAGE FORMING APPARATUS INCLUDING THE SAME

(71) Applicant: FUJI XEROX CO., LTD., Minato-ku, Tokyo (JP)

(72) Inventors: Munenobu Okubo, Kanagawa (JP); Yasuyuki Tsutsumi, Kanagawa (JP); Shinji Mitsui, Kanagawa (JP); Kazuaki Iikura, Kanagawa (JP); Yosuke Ninomiya, Kanagawa (JP); Yoshifumi Ozaki, Kanagawa (JP); Akihiko Noda, Kanagawa (JP); Hirokazu Hamano, Kanagawa (JP); Takafumi Wakai, Kanagawa (JP); Masaru Sakuma, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 166 days.

(21) Appl. No.: 13/865,331

(22) Filed: Apr. 18, 2013

(65) Prior Publication Data

US 2014/0147141 A1 May 29, 2014

(30) Foreign Application Priority Data

Nov. 27, 2012 (JP) ..... 2012-259178

(51) Int. Cl.
*G03G 15/08* (2006.01)

(52) U.S. Cl.
CPC ..... *G03G 15/0891* (2013.01); *G03G 15/0808* (2013.01)

(58) Field of Classification Search
CPC ..... G03G 15/0891; G03G 15/0808
USPC ..... 399/257, 258, 260, 281, 283
See application file for complete search history.

(56) References Cited

U.S. PATENT DOCUMENTS

| | | | | |
|---|---|---|---|---|
| 5,594,198 | A * | 1/1997 | Ikeda et al. | 399/281 |
| 7,764,911 | B2 | 7/2010 | Itabashi | |
| 8,139,990 | B2 * | 3/2012 | Okada et al. | 399/281 |
| 8,526,864 | B2 * | 9/2013 | Nakagawa et al. | 399/281 |
| 2002/0159796 | A1 | 10/2002 | Koyama et al. | |

FOREIGN PATENT DOCUMENTS

| | | | |
|---|---|---|---|
| JP | 2002-323814 | A | 11/2002 |
| JP | 2005-257815 | A | 9/2005 |
| JP | 2009-031783 | A | 2/2009 |
| JP | 2010-211052 | A | 9/2010 |

* cited by examiner

*Primary Examiner* — William J Royer
(74) *Attorney, Agent, or Firm* — Sughrue Mion, PLLC

(57) ABSTRACT

A developing device includes a transporting unit that rotates while facing an image carrier that carries an electrostatic latent image, the transporting unit transporting developer toward the image carrier; a feeding unit that contacts the transporting unit to feed the developer to the transporting unit; a transport path that connects a containing chamber that contains the developer to a feeding chamber that houses the feeding unit; a supplying unit that retains the developer to be supplied in the transport path and supplies the developer to the feeding unit in a supply region that is separated from a contact region in which the feeding unit contacts the transporting unit; and an attaching unit that is disposed downstream of the contact region and upstream of the supply region in a rotation direction of the feeding unit and that attaches the developer to the feeding unit at a location below the contact region.

9 Claims, 18 Drawing Sheets

DEVELOPING DEVICE HAVING AN ATTACHING UNIT FOR ATTACHING DEVELOPER AND IMAGE FORMING APPARATUS INCLUDING THE SAME

CROSS-REFERENCE TO RELATED APPLICATIONS

This application is based on and claims priority under 35 USC 119 from Japanese Patent Application No. 2012-259178 filed Nov. 27, 2012.

BACKGROUND

1. Technical Field

The present invention relates to a developing device and an image forming apparatus including the developing device.

2. Summary

According to an aspect of the invention, there is provided a developing device that includes a transporting unit that rotates while facing an image carrier that rotates while carrying an electrostatic latent image, the transporting unit transporting developer toward the image carrier so that the electrostatic latent image on the image carrier is developed; a feeding unit having a peripheral surface that rotates and to which the developer is attached, the feeding unit contacting the transporting unit to feed the developer to the transporting unit; a transport path that connects a containing chamber that contains the developer to a feeding chamber that houses the feeding unit; a supplying unit that retains the developer to be supplied to the feeding unit in the transport path and supplies the developer to the feeding unit in a supply region that is separated from a contact region in which the feeding unit contacts the transporting unit; and an attaching unit that is disposed downstream of the contact region and upstream of the supply region in a rotation direction of the feeding unit, the attaching unit attaching the developer to the feeding unit with an elastic force at a location below the contact region.

BRIEF DESCRIPTION OF THE DRAWINGS

Exemplary embodiments of the present invention will be described in detail based on the following figures, wherein.

DETAILED DESCRIPTION

Summary of the Exemplary Embodiments

Figure 1A:
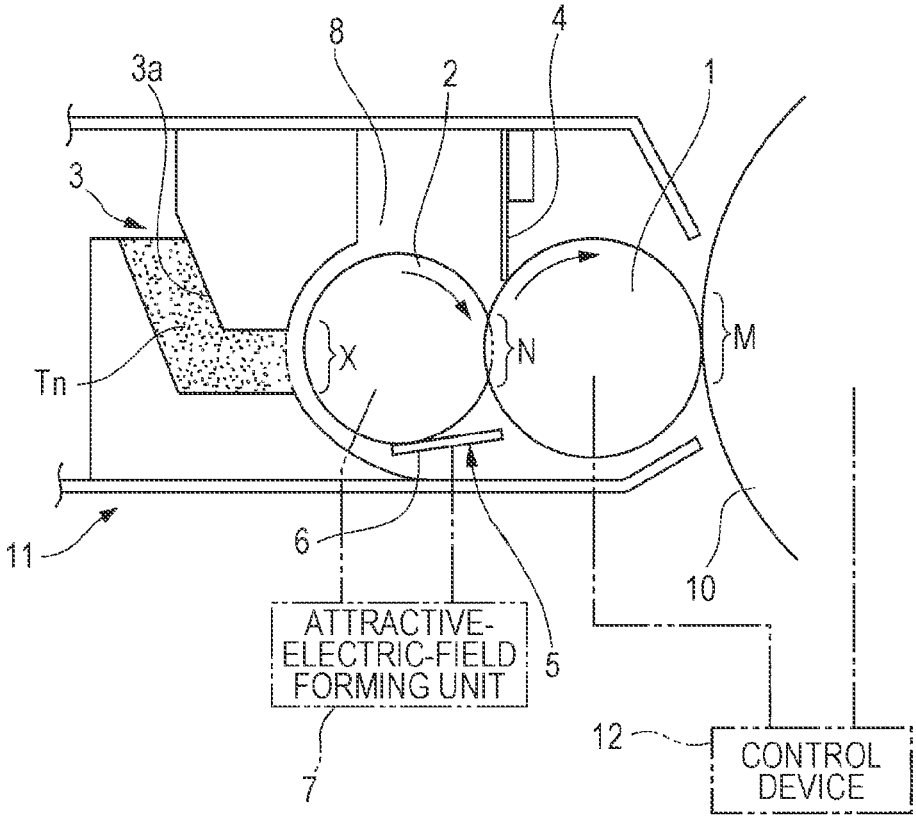
FIG. 1A schematically illustrates an image forming apparatus including a developing device according to an exemplary embodiment of the present invention.

FIG. 1A schematically illustrates an image forming apparatus including a developing device according to an exemplary embodiment of the present invention;

Referring to FIG. 1A, the image forming apparatus includes an image carrier 10 that rotates while carrying an electrostatic latent image and a developing device 11 that faces the image carrier 10 and develops the electrostatic latent image on the image carrier 10.

Figure 1B:
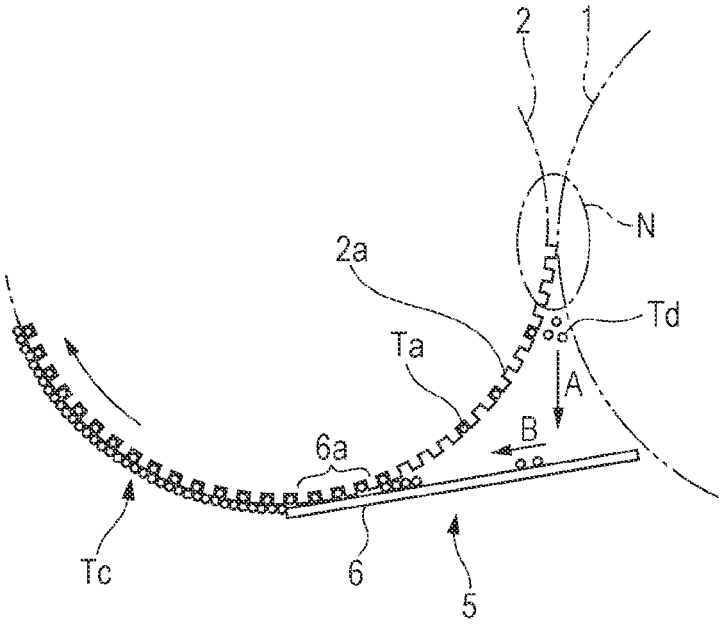
FIG. 1B schematically illustrates an attaching unit illustrated in FIG. 1A.

Referring to FIGS. 1A and 1B, in this exemplary embodiment, the developing device 11 includes a toner carrier 1, a feeding member 2, a toner supplying unit 3, a regulating member 4, and an attaching unit 5. The toner carrier 1 is rotatably arranged so as to face the image carrier 10 that rotates while carrying the electrostatic latent image. The toner carrier 1 functions as a transporting unit that carries non-magnetic one-component toner, which serves as developer, and conveys the toner toward a developing region M in which the toner carrier 1 faces the image carrier 10, so that the electrostatic latent image on the image carrier 10 is developed. The feeding member 2 includes an elastically deformable elastic body having a rough surface 2*a* capable of capturing the toner at the periphery thereof. The feeding member 2 is rotatably arranged so as to elastically contact the toner carrier 1, and serves as a feeding unit that feeds the toner to the toner carrier 1 in a contact region N in which the feeding member 2 contacts the toner carrier 1. The toner supplying unit 3 faces the feeding member 2 in a supply region X that is separated from the contact region N between the feeding member 2 and the toner carrier 1, and serves as a supplying unit that supplies new toner. The regulating member 4 is disposed near the toner carrier 1 at a location downstream of the contact region N between the feeding member 2 and the toner carrier 1 and upstream of the developing region M of the toner carrier 1 in a rotation direction of the toner carrier 1. The regulating member 4 triboelectrically charges the toner on the toner carrier 1 and regulates the amount of toner used in the developing process. The attaching unit 5 is disposed near the feeding member 2 at a location downstream of the contact region N between the feeding member 2 and the toner carrier 1 and upstream of the supply region X of the toner supplying unit 3 in a rotation direction of the feeding member 2. The attaching unit 5 includes a guide member 6 that receives released toner Td that has been released upon passing through the contact region N at a position below the contact region N and guides the released toner Td toward the feeding member 2. A portion of the guide member 6 is pressed against the peripheral surface of the feeding member 2, so that the released toner Td received by the guide member 6 is moved to the feeding member 2 and attached to the peripheral surface of the feeding member 2.

In the above-described technical configuration, the toner carrier 1 is not particularly limited as long as the toner carrier 1 is configured to carry the toner to the developing region M between the toner carrier 1 and the image carrier 10.

The rotation direction of the feeding member 2 may either be such that opposing portions of the feeding member 2 and the toner carrier 1 move in opposite directions or in the same direction. In the case where the opposing portions of the feeding member 2 and the toner carrier 1 move in the same direction, the opposing portions need to move at different speeds to allow the toner to be fed from the feeding member 2 to the toner carrier 1. The feeding member 2 is not particularly limited as long as the feeding member 2 has a rough (irregular) peripheral surface capable of capturing the toner. A typical example of the feeding member 2 is made of a foamed material. However, an elastic rubber member, for example, having recesses such as grooves in the peripheral surface thereof may instead be used. The foamed material may either be an open-cell foam or a closed-cell form. The open-cell foam may be used from the viewpoint of softness and cost.

The toner supplying unit 3 is not particularly limited as long as the toner supplying unit 3 is capable of supplying new toner Tn to the predetermined supply region X of the feeding member 2. A containing chamber (not shown) that contains the new toner Tn may be provided near the feeding member 2, and the new toner Tn contained in the containing chamber may be supplied to the supply region X of the feeding member 2 through a toner transport path 3*a*.

The supply region X to which the new toner Tn is supplied by the toner supplying unit 3 is separated from the contact region N between the feeding member 2 and the toner carrier 1. The reason for this is because if the toner supplying unit 3 supplies the new toner Tn directly to the contact region N between the feeding member 2 and the toner carrier 1, the new toner Tn will be positively mixed with an old toner Tc on the feeding member 2.

The regulating member 4 is not particularly limited as long as the regulating member 4 is configured to triboelectrically charge the toner carried by the toner carrier 1 and regulate the amount of the toner to a predetermined amount. Although a typical example of the regulating member 4 is a plate-shaped member that extends against the rotation direction of the toner carrier 1 and elastically contacts the toner carrier 1, a rotating member, for example, may instead be used. The regulating member 4 triboelectrically charges the toner fed from the feeding member 2 to the toner carrier 1. Therefore, if the new toner in and the old toner Tc having different electrification characteristics are mixed, the amount of charge differs between the new toner Tn and the old toner Tc by a large amount and the width of the charge distribution increases. When most of the toner captured by the feeding member 2 is old toner Tc, the amount of charge does not vary and the width of the charge distribution does not increase because the electrification characteristics of the old toner Tc are substantially uniform.

The attaching unit 5 is not particularly limited as long as the guide member 6 is included. The guide member 6 is not particularly limited as long as the guide member 6 is configured to receive the released toner Td that has been released upon passing through the contact region N as shown by arrow A in FIG. 1B and guide the released toner Td toward the feeding member 2 as shown by arrow B in FIG. 1B. A portion of the guide member 6 needs to be pressed against the feeding member 2. Since a pressed portion 6*a* is provided, the released toner Td that has been moved toward the feeding member 2 may be attached to the feeding member 2. The released toner Td is attached to the surface of the feeding member 2 so as to fill the recesses in the rough surface 2*a*. The released toner Td is also attached to the feeding member 2 in regions outside the recesses, and is substantially uniformly leveled. In FIG. 1B, Ta denotes toner (remaining toner) that remains in the recesses in the rough surface 2*a* of the feeding member 2.

The above-described guide member 6 may be a plate-shaped member, a rotatable member, and the like, as appropriate.

Next, a typical example of a developing device will be described.

A typical example of the attaching unit 5 includes an elastically deformable plate-shaped member as the guide member 6, the plate-shaped member being inclined so that the pressed portion 6*a* thereof that is pressed against the feeding member 2 is below a portion thereof that receives the released toner Td.

In this example, the plate-shaped member that serves as the guide member 6 may have a smooth surface that allows particles of the released toner Td to roll toward the feeding member 2. Here, the "smooth surface" is a surface having an arithmetical mean roughness of, for example, $Rz \leq 0.6$ μm.

The toner carrier 1 and the feeding member 2 may be configured to rotate such that opposing portions thereof move in different directions. In this against-type configuration, the toner that has been captured by the feeding member 2 is released from the feeding member 2 by applying a shear force. Some of the released toner Td is fed to the toner carrier 1, and the remaining released toner Td falls. The surface of the feeding member 2 elastically returns to its original shape after passing through the contact region N. Accordingly, the toner that has remained on the surface of the feeding member 2 also falls when the surface of the feeding member 2 elastically returns to its original shape.

As illustrated in FIGS. 1A and 1B, the guide member 6 may be formed of a conductive member, and an attractive-electric-field forming unit 7 that forms an attractive electric field may be provided between the feeding member 2 and the guide member 6, the attractive electric field being capable of attracting the released toner Td to the feeding member 2. The attractive-electric-field forming unit 7 forms the attractive electric field between the feeding member 2 and the guide member 6, so that the released toner Td guided by the guide member 6 is attracted to the feeding member 2.

The guide member 6 may be configured such that a contact force applied to the feeding member 2 by the guide member 6 is smaller than a contact force applied between the feeding member 2 and the toner carrier 1 in the contact region N. If the contact force applied between the feeding member 2 and the guide member 6 is too large, the feeding member 2 will be deformed by a large amount by the guide member 6 and there is a risk that the toner attached to the feeding member 2 will be released again when the feeding member 2 elastically returns to its original shape after passing the pressed portion 6*a* of the guide member 6.

The toner supplying unit 3 may be configured to connect the containing chamber (not shown) to a developing chamber 8 with the toner transport path 3*a*. The containing chamber contains the new toner Tn such that the new toner Tn is capable of being supplied. The developing chamber 8 houses the feeding member 2 and the toner carrier 1. The toner transport path 3*a* has a containing-chamber-side opening and a developing-chamber-side opening that faces the feeding member 2 and that is located below the containing-chamber-side opening.

In this example, the new toner Tn is retained in the toner transport path 3*a* so as to fill the toner transport path 3*a*, and the new toner Tn retained in the toner transport path 3*a* is arranged so as to face the feeding member 2 owing to its own weight. Therefore, it may be assumed that an interface is formed between the new toner Tn retained in the toner transport path 3*a* and the peripheral surface of the feeding member 2, so that the new toner Tn is not supplied to the feeding member 2 in regions where the old toner Tc is captured on the peripheral surface of the feeding member 2 and is supplied to the feeding member 2 only in regions where the old toner Tc is not captured on the peripheral surface of the feeding member 2. The old toner Tc captured by the feeding member 2 is pressed by the new toner Tn retained in the toner transport path 3*a*, and is therefore prevented from being mixed into the new toner Tn retained in the toner transport path 3*a*.

An example of an image forming apparatus including the above-described developing device 11 includes a control device 12 capable of controlling the toner consumption, as illustrated in FIG. 1A.

The control device 12 of this type may include a calculating unit that calculates an amount of toner consumption when, for example, an amount of image formation reaches a predetermined amount; a determining unit that determines whether or not the amount of toner consumption calculated by the calculating unit is greater than or equal to a predetermined threshold; an ejecting unit that ejects a predetermined amount of toner from the developing device 11 toward the image carrier 10 when it is determined by the determining unit that the amount of toner consumption is less than the threshold; and a cleaning process unit that cleans the image carrier 10 by removing the toner that has been ejected to the image carrier 10 by the ejecting unit.

In the case where the amount of toner consumption is small, the state in which the old toner Tc is not consumed and remains on the feeding member 2 continues, and therefore the toner is easily degraded. Accordingly, in this example, the toner is removed before it is degraded to stabilize the developing quality.

A typical example of the calculating unit that calculates the amount of toner consumption performs the calculation on the basis of an image density. The amount of image formation may be determined by, for example, counting the number of sheets in terms of the number of sheets having a standard size, or measuring the operating time of the developing device 11. The threshold used for the determination may, for example, be experimentally determined as a limit (lower allowable limit) of a range in which developing failure does not occur. The ejecting unit is not particularly limited as long as the ejecting unit is configured to forcedly eject the toner from the developing device 11 when the developing failure is likely to occur and it is assumed that the toner captured by the feeding member 2 is degraded. Typically, the toner ejection operation is performed by forming a toner-ejecting electrostatic latent image on the image carrier 10 and developing the toner-ejecting electrostatic latent image. The image formed in the toner ejection operation is not particularly limited, and may be a solid image or other images. Different types of images may be formed depending on the amount of toner consumption. The amount of toner to be ejected needs to be increased as the amount of toner consumption decreases. The cleaning process unit generally uses a cleaning unit for the image carrier 10. However, the cleaning process unit is not limited to this, and may instead clean the image carrier 10 by causing the toner to be transferred onto a recording medium or by using another cleaning member.

Exemplary embodiments of the present invention illustrated in the accompanying drawings will now be described in detail.

First Exemplary Embodiment

Overall Structure of Image Forming Apparatus

Figure 2:
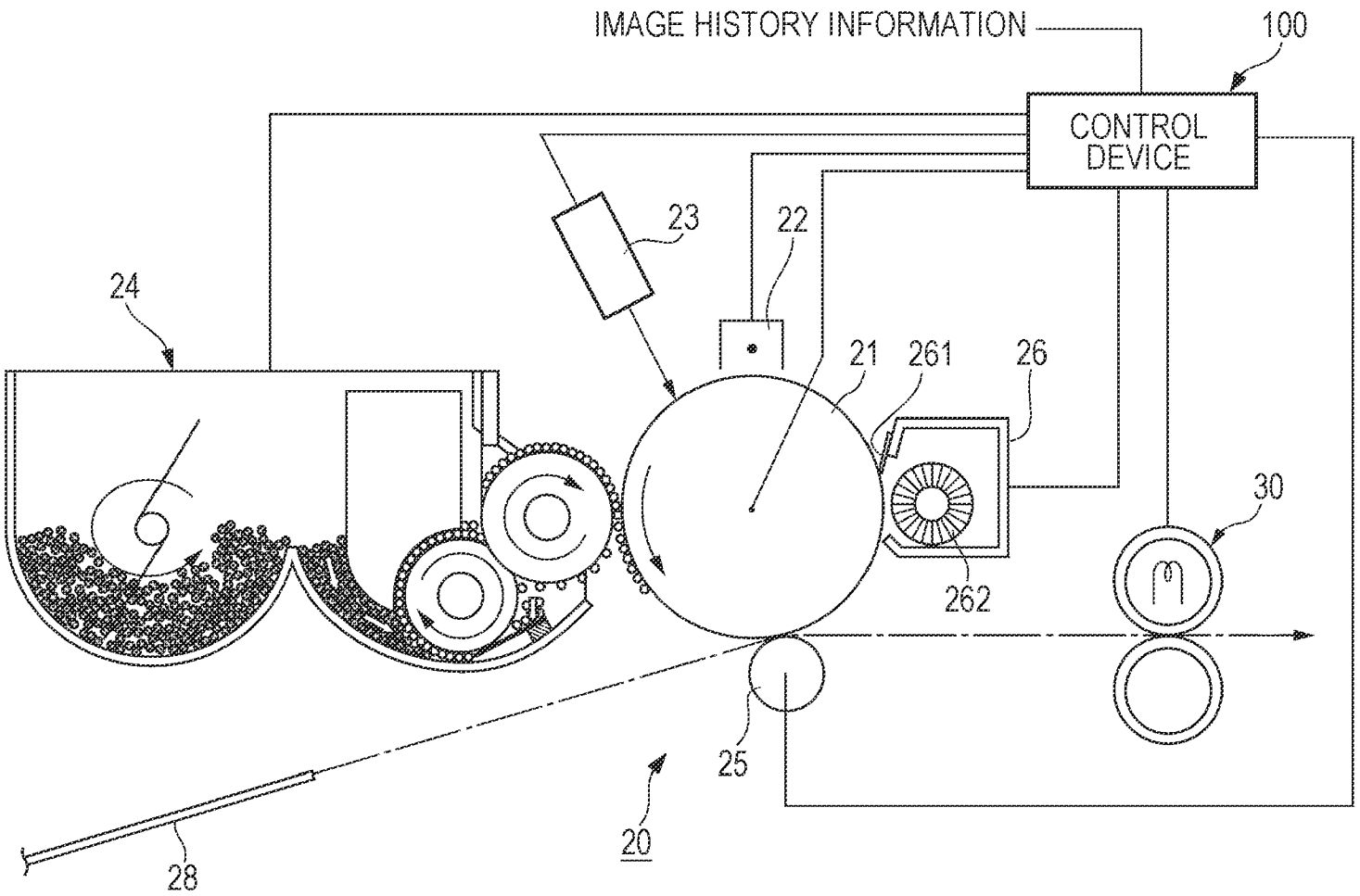
FIG. 2 illustrates the overall structure of an image forming apparatus according to a first exemplary embodiment.

FIG. 2 illustrates the overall structure of an image forming apparatus 20 according to a first exemplary embodiment.

Referring to FIG. 2, the image forming apparatus 20 includes a drum-shaped photoconductor 21 that functions as an image carrier; a charging device 22 that charges the photoconductor 21; an exposure device 23 that writes an electrostatic latent image with light on the photoconductor 21 charged by the charging device 22; a developing device 24 that visualizes the electrostatic latent image written on the photoconductor 21 with developer (toner); a transfer device 25 that transfers the toner image visualized by the developing device 24 onto a recording medium 28 that functions as a transfer medium; and a cleaning device 26 that cleans the photoconductor 21 by removing residual toner that remains on the photoconductor 21 after the transfer process is performed by the transfer device 25.

In this example, the recording medium 28 is ejected after the image that has been transferred onto the recording medium 28 is fixed by a fixing device 30. A control device 100 controls the components of the image forming apparatus 20. Although the recording medium 28 is described as an example of the transfer medium, the transfer medium is not limited to this, and may instead be an intermediate transfer body that temporarily carries the toner image before the toner image is transferred onto the recording medium 28.

The photoconductor 21 includes a drum-shaped metal frame body and a photosensitive layer formed on the metal frame body.

The charging device 22 may include, for example, a charging container and a discharge wire that is disposed in the charging container as a charging member. However, the charging device 22 is not limited to this, and may instead include, for example, a roll-shaped charging member as appropriate.

The exposure device 23 may be a laser scanning device or a light-emitting-diode (LED) array.

The developing device 24 is a one-component developer type developing device that uses non-magnetic toner. The developing device 24 will be described in detail below.

The transfer device 25 is not particularly limited as long as the transfer device 25 is configured to generate a transfer electric field that causes the toner image on the photoconductor 21 to be electrostatically transferred onto the recording medium 28. The transfer device 25 may include, for example, a roll-shaped transfer member to which a transfer voltage is applied. However, the transfer device 25 is not limited to this, and a transfer corotron including a discharge wire, for example, may instead be used as appropriate.

The cleaning device 26 illustrated in FIG. 2 includes a cleaning container that has an opening facing the photoconductor 21 and that receives residual toner; a plate-shaped cleaning member 261, such as a blade or a scraper, disposed at a downstream edge of the opening in the cleaning container in a rotation direction of the photoconductor 21; and a brush-shaped or roll-shaped rotating cleaning member 262 that is disposed upstream of the plate-shaped cleaning member 261 in the rotation direction of the photoconductor 21. However, the cleaning device 26 is not limited to this and may have other structures as appropriate.

All or some of the photoconductor 21, the charging device 22, the developing device 24, and the cleaning device 26 may be assembled together in advance as a process cartridge, which is an image forming assembly, and be detachably attached to a receiving section provided in a housing of the image forming apparatus 20.

Basic Structure of Developing Device

In this example, as illustrated in FIGS. 2 to 5, the developing device 24 includes a developing container 40 that contains non-magnetic toner T and has an opening facing the photoconductor 21. A developing roller 41 is disposed in the opening of the developing container 40, and a feeding roller 42 that is capable of feeding the non-magnetic toner T in the developing container 40 to the developing roller 41 is disposed behind the developing roller 41. A plate-shaped charging blade 45 is provided on the developing roller 41 at a location downstream of the region in which the non-magnetic toner T is fed by the feeding roller 42 in a toner transporting direction. A toner supplying mechanism 60 that is capable of supplying new non-magnetic toner Tn to the feeding roller 42 is provided behind the feeding roller 42.

A sealing member (not shown) composed of an elastic member is fixed at one end to the bottom edge of the opening in the developing container 40, and a free end of the sealing member is in elastic contact with the developing roller 41. Thus, the gap between the developing roller 41 and the developing container 40 is covered.

Developing Roller and Feeding Roller

In this example, the developing roller 41 rotates so that opposing portions of the developing roller 41 and the photoconductor 21 move in the same direction. The developing roller 41 includes a metal shaft 41*a* and a roller body layer 41*b* that is formed around the metal shaft 41*a* and made of a resin or a rubber having a predetermined volume resistivity. The surface of the roller body layer 41*b* has a certain surface roughness so as to be capable of carrying the toner.

The feeding roller 42 rotates so that opposing portions of the feeding roller 42 and the developing roller 41 move in opposite directions. The feeding roller 42 includes a metal shaft 42*a* and an elastically deformable elastic layer 42*b* that is formed around the metal shaft 42*a* and has a predetermined volume resistivity. The elastic layer 42*b* is made of, for example, a foamed material, such as urethane foam sponge rubber, and has a rough surface 42*c* (see FIG. 5) that is capable of reliably capturing the toner.

In this example, the elastic layer 42*b* of the feeding roller 42 is sufficiently softer than the roller body layer 41*b* of the developing roller 41. Therefore, the developing roller 41 and the feeding roller 42 are arranged such that the developing roller 41 intrudes into the elastic layer 42*b* of the feeding roller 42 by a predetermined amount. With this arrangement, a contact region N (nip region) is formed between the developing roller 41 and the feeding roller 42. In this example, the feeding roller 42 is rotated so as to move downward and the developing roller 41 is rotated so as to move upward in the contact region N between the developing roller 41 and the feeding roller 42.

Accordingly, the feeding roller 42 serves functions of removing the toner that has been transported by the developing roller 41 from the developing roller 41 and feeding the toner on the feeding roller 42 to the developing roller 41 in the contact region N between the developing roller 41 and the feeding roller 42. The developing roller 41 transports the non-magnetic toner fed from the feeding roller 42 to a developing region M in which the developing roller 41 faces the photoconductor 21, so that the non-magnetic toner T is used in a developing process in the developing region M.

Charging Blade

The charging blade 45 is composed of, for example, a metal plate made of phosphor bronze or the like, and is fixed at one end to an edge of the opening in the developing container 40. The charging blade 45 extends so as to project in a direction opposite to a rotation direction of the developing roller 41, and is pressed against the surface of the developing roller 41 at a predetermined pressing force. Therefore, the toner T held by the developing roller 41 is triboelectrically charged when the toner T passes through the region in which the charging blade 45 is pressed against the developing roller 41, and the amount of transported toner T is regulated to a predetermined amount. The charging blade 45 is fixed to the edge of the opening in the developing container 40 by a bracket 46.

Developing Container

The developing container 40 includes a developing chamber 51 that houses the developing roller 41 and the feeding roller 42 and a containing chamber 52 that is adjacent to the developing chamber 51 and that contains the new toner Tn that may be supplied to the developing chamber 51.

In this example, a block-shaped partition member 53 that separates the developing chamber 51 and the containing chamber 52 from each other is disposed in the developing container 40 separately from the bottom wall of the developing container 40. The bottom wall of the developing container 40 includes two curved portions 40*a* and 40*b* that are curved so as to protrude downward and formed integrally with each other, and a ridge-shaped separating portion 54 is formed at the boundary between the curved portions 40*a* and 40*b*.

Toner Supplying Mechanism

In this example, the toner supplying mechanism 60 is configured such that the new toner Tn is contained in the containing chamber 52 of the developing container 40 and the containing chamber 52 is connected to the developing chamber 51 with a toner transport path 61. An agitator 62, which functions as a stirring-and-transporting member, is disposed in the containing chamber 52. The agitator 62 transports the new toner Tn to the developing chamber 51 through the toner transport path 61 while stirring the new toner Tn.

The curved portion 40*b*, which is a portion of the bottom wall of the developing container 40 that corresponds to the containing chamber 52, has a curvature corresponding to that of the trajectory of free ends of the agitator 62.

Toner Transport Path

In this example, the toner transport path 61 is formed between the partition member 53 and the curved portion 40*a*, which is a portion of the bottom wall of the developing container 40.

Figure 5:
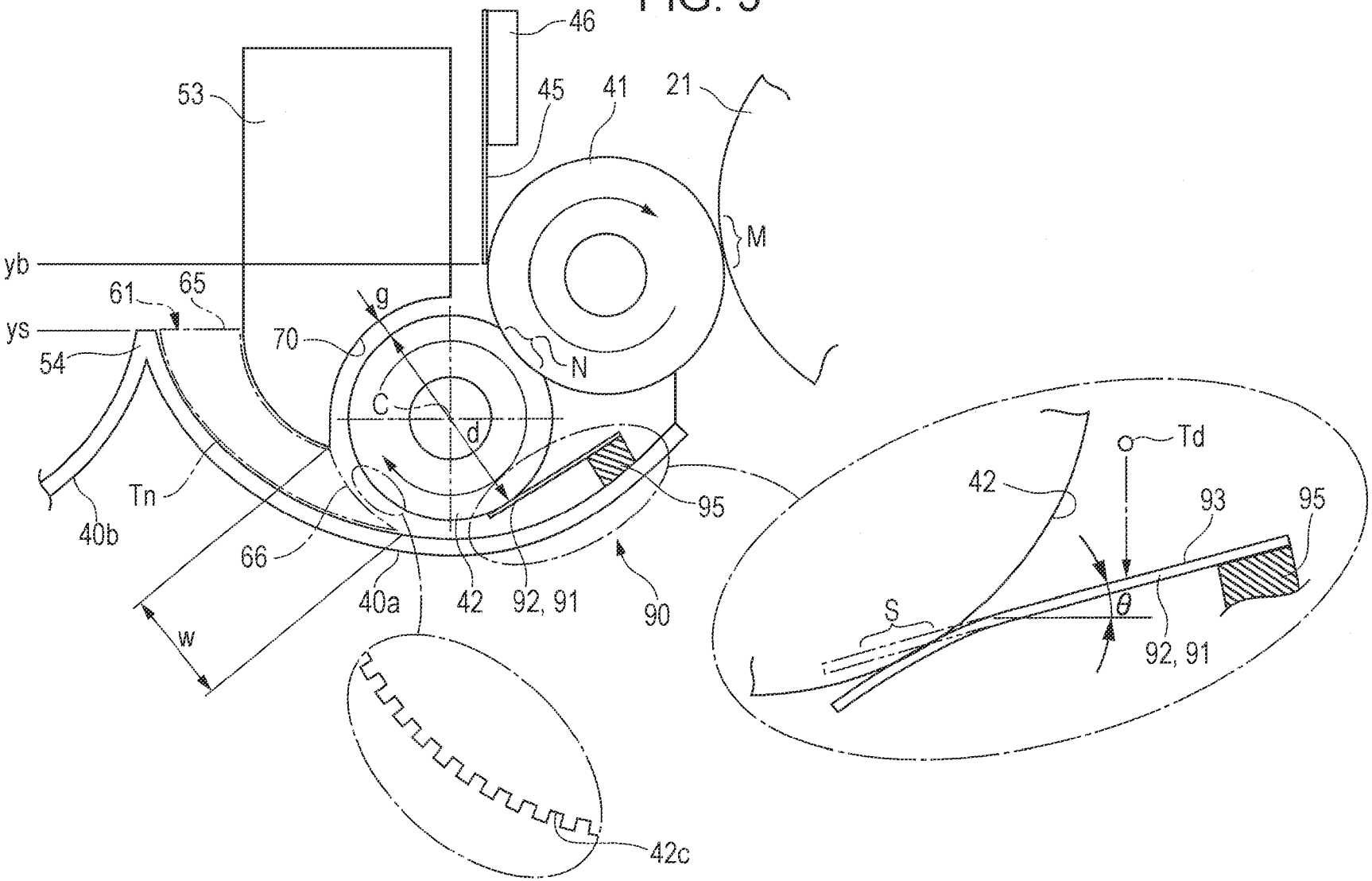
FIG. 5 illustrates the details of the part of the developing device illustrated in FIG. 4.

As illustrated in FIG. 5, the toner transport path 61 is formed such that a containing-chamber-side opening 65 thereof is positioned above a developing-chamber-side opening 66 thereof, and is curved along the curved portion 40*a* from the containing chamber 52 toward the developing chamber 51.

The developing-chamber-side opening 66 of the toner transport path 61 is arranged so as to face the feeding roller 42, and defines a supply region X (FIG. 7A) in which the new toner Tn is supplied to the developing chamber 51.

In particular, in this example, the developing-chamber-side opening 66 of the toner transport path 61 is separated from the contact region N between the developing roller 41 and the feeding roller 42 (substantially halfway around the feeding roller 42 in this example), and is positioned below the center C of the feeding roller 42. The width w of the developing-chamber-side opening 66 along a rotation direction of the feeding roller 42 is smaller than the outer diameter d of the feeding roller 42 in a plane of projection in a direction from the feeding roller 42.

In this example, the new toner Tn in the containing chamber 52 is transported to the toner transport path 61 by the agitator 62. Therefore, as shown by one-dot chain lines in FIG. 5, the new toner Tn is retained in the toner transport path 61 by its own weight so as to fill the toner transport path 61, and presses the feeding roller 42 through the developing-chamber-side opening 66.

Separating Portion and Partition Member

The containing-chamber-side opening 65 of the toner transport path 61 is at a position ys corresponding to the top of the ridge-shaped separating portion 54 that is formed integrally with a portion of the bottom wall of the developing container 40. The containing-chamber-side opening 65 may be positioned at least below a contact position yb at which the charging blade 45 contacts the developing roller 41. According to the above-described dimensional relationship, even when the new toner Tn is retained in the toner transport path 61 so as to fill the toner transport path 61, the toner in the developing chamber 51 is prevented from being pushed up to the contact position yb at which the charging blade 45 contacts the developing roller 41 by the pressure applied by the new toner Tn retained in the toner transport path 61. As a result, the risk that a region around the charging blade 45 in the developing chamber 51 will be filled with the toner and the state in which the charging blade 45 is pressed against the developing roller 41 will be changed may be effectively reduced.

In this example, the partition member 53 has a curved regulating surface 70 in a region adjacent to the developing-chamber-side opening 66 of the toner transport path 61. The regulating surface 70 faces the feeding roller 42 and extends along the peripheral surface of the feeding roller 42 with a gap g therebetween. The gap g is not particularly limited as long as the toner layer to be formed on the feeding roller 42 may be regulated, but is set so that an amount of toner that satisfies the maximum toner consumption per unit time of the developing device 24 may be supplied. In this example, the gap g is set in the range of 0.5 mm to 1.0 mm. Here, the lower limit (0.5 mm) is set in consideration of mounting tolerance so as to allow the partition member 53 to be mounted in the developing container 40 without causing the partition member 53 to contact the feeding roller 42, and the upper limit (1.0 mm) is set so that the toner layer to be formed on the feeding roller 42 may be regulated.

Electric-Field-Forming Power Supply

In this example, the developing roller 41 is provided with a developing power supply 81 for generating a developing electric field between the developing roller 41 and the photoconductor 21, and the feeding roller 42 is provided with a feeding power supply 82 for generating a feeding electric field for feeding the non-magnetic toner T to the developing roller 41.

The developing power supply 81 applies a developing voltage obtained by superimposing an alternating-current component on a predetermined direct-current component to the developing roller 41. The feeding power supply 82 applies a feeding voltage obtained by superimposing an alternating-current component having the same period as that of the alternating-current component of the voltage applied by the developing power supply 81 on a direct-current component having a predetermined potential difference (including '0') relative to the direct-current component of the voltage applied by the developing power supply 81.

In the case where the toner may be reliably fed from the feeding roller 42 to the developing roller 41 in the contact region N even when the feeding electric field is not generated between the developing roller 41 and the feeding roller 42, the developing power supply 81 may, of course, be used also as the feeding power supply 82 so that the potential difference between the developing roller 41 and the feeding roller 42 is set to substantially 0.

Attaching Mechanism

In the present exemplary embodiment, an attaching mechanism 90 is provided below the contact region N between the developing roller 41 and the feeding roller 42 in the developing chamber 51 of the developing container 40. The attaching mechanism 90 attaches the toner released from the developing roller 41 and the feeding roller 42 to the feeding roller 42.

As illustrated in FIG. 5, the attaching mechanism 90 of this example includes a guide member 91 that receives released toner Td that has been released upon passing through the contact region N and guides the released toner Td toward the feeding roller 42. A portion of the guide member 91 is pressed against the peripheral surface of the feeding roller 42, so that the released toner Td received by the guide member 91 is moved to the feeding roller 42 and attached to the peripheral surface of the feeding roller 42.

In this example, the guide member 91 is composed of an elastically deformable elastic sheet 92, one end of which is fixed to an attachment member 95 provided on a portion of the bottom wall of the developing container 40. The elastic sheet 92 is inclined by an inclination angle of θ with respect to a horizontal direction so that a pressed portion S of the elastic sheet 92 that is pressed against the feeding roller 42 is below a portion of the elastic sheet 92 that receives the released toner Td.

The elastic sheet 92 of this type may be, for example, a thermoplastic polyurethane sheet, a polyimide sheet, a polyester sheet, or a PET sheet. A lower limit of the inclination angle θ of the elastic sheet 92 is set to a value (for example, 10°) in a range in which particles of the released toner Td may roll along the elastic sheet 92. When the inclination angle θ is excessively large, the volume of a toner-receiving region that receives the released toner Td decreases. Therefore, an upper limit of the inclination angle θ is set to a value (for example, 45°) in a range in which releasing failure due to an increase in the pressure of the toner in the toner-receiving region does not occur at the feeding roller 42.

In this example, the elastic sheet 92 may have a smooth surface 93 at a front side thereof (side at which the elastic sheet 92 receives the released toner Td), the smooth surface 93 allowing the particles of the released toner Td to roll toward the feeding roller 42. Here, the smooth surface 93 is a surface having an arithmetical mean roughness Rz of, for example, Rz≤0.6 μm.

In this example, the pressed portion S of the elastic sheet 92 is near an end of the elastic sheet 92, and a contact force applied to the feeding roller 42 by the elastic sheet 92 is smaller than a contact force applied between the developing roller 41 and the feeding roller 42 in the contact region N. More specifically, when an amount of deformation of the elastic sheet 92 is defined as an amount by which the elastic sheet 92 is elastically deformed by being pressed against the feeding roller 42 from the state in which the elastic sheet 92 is straight and not elastically deformed, the contact force may be calculated from the modulus of elasticity of the elastic sheet 92 and the amount of deformation. Accordingly, the contact force of the elastic sheet 92 may be appropriately set.

In this example, the pressed portion S of the elastic sheet 92 is closer to the contact region N than the bottom portion of the feeding roller 42. Therefore, in the pressed portion S of the elastic sheet 92, the contact force gradually increases toward the end of the elastic sheet 92.

Basic Operation of Developing Device

Figure 3:
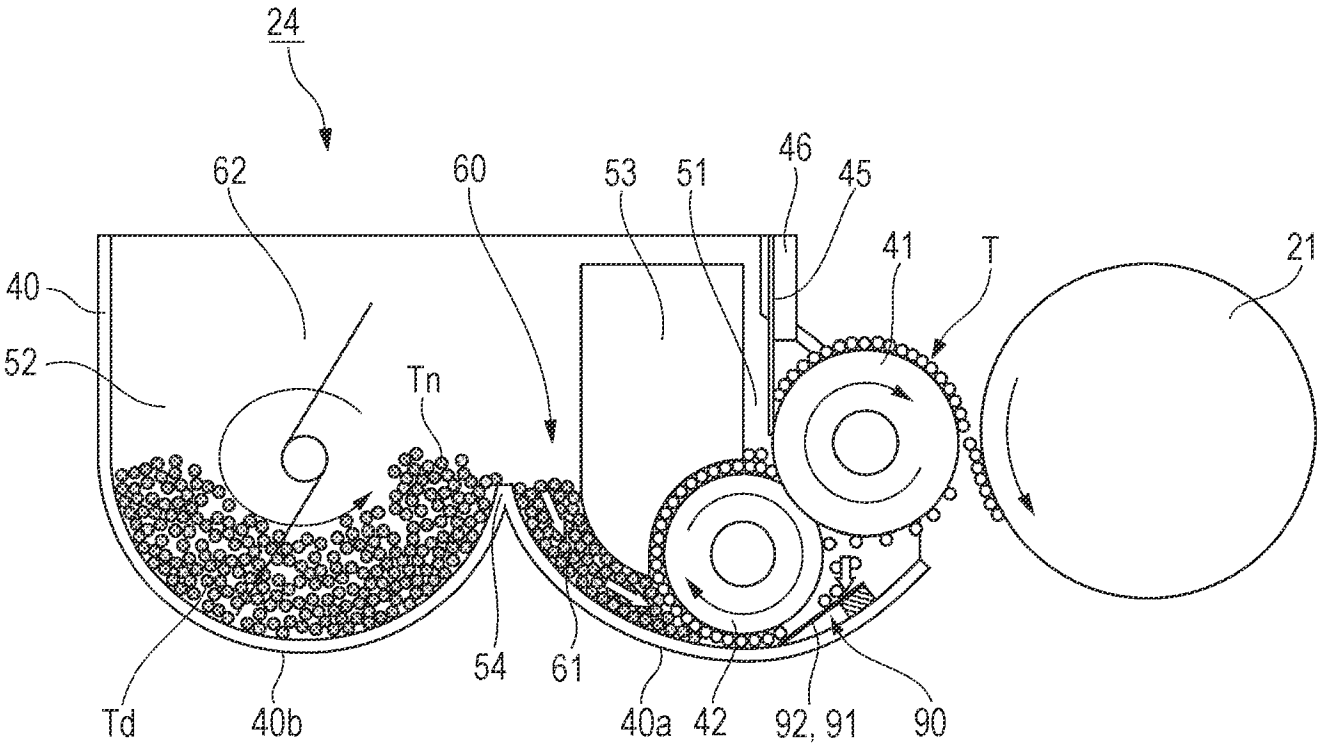
FIG. 3 illustrates a developing device according to the first exemplary embodiment.
Figure 4:
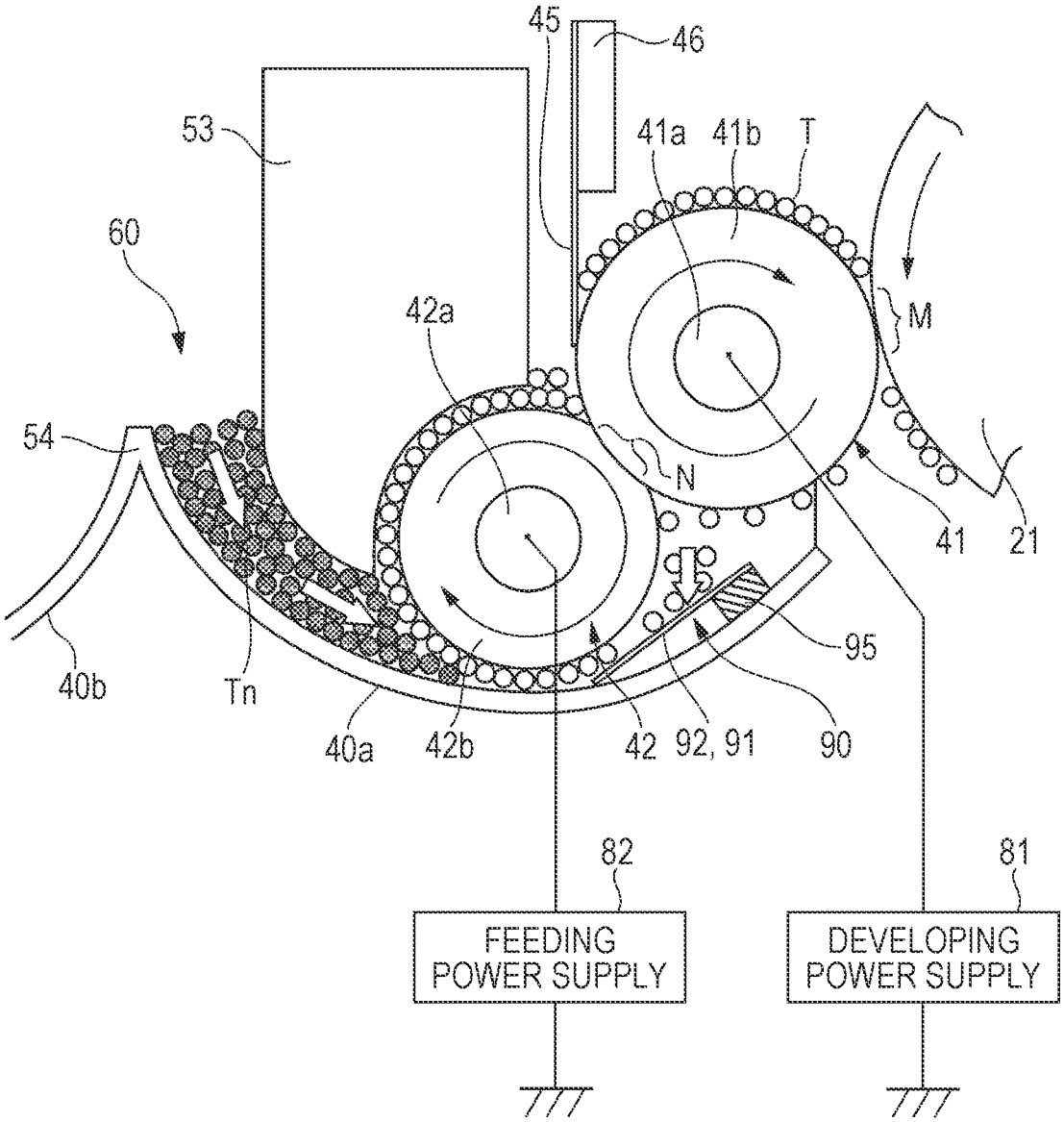
FIG. 4 illustrates a part of the developing device illustrated in FIG. 3.

In the developing device 24 according to the present exemplary embodiment, as illustrated in FIG. 3, the feeding roller 42 rotates while the toner T is captured thereon and transports the toner T to the contact region N between the developing roller 41 and the feeding roller 42.

In this example, the opposing portions of the developing roller 41 and the feeding roller 42 move in opposite directions in the contact region N. Therefore, when the toner T captured by the feeding roller 42 reaches the contact region N, some of the toner T is fed to the developing roller 41, and the remaining toner T remains on the feeding roller 42 or is released and falls.

The toner T fed to the developing roller 41 is transported by the rotation of the developing roller 41, and passes the charging blade 45. When the toner T passes the charging blade 45, the toner T is triboelectrically charged and the amount thereof is regulated to a predetermined amount. Then, the toner T is transported to the developing region M between the developing roller 41 and the photoconductor 21, and is used to develop the electrostatic latent image formed on the photoconductor 21.

Remaining unused toner Te that has passed through the developing region M of the developing roller 41 is transported to the contact region N between the developing roller 41 and the feeding roller 42 by the rotation of the developing roller 41. Most of the remaining unused toner Te is scraped off from the developing roller 41 in the contact region N and is released (see FIG. 6A).

Figure 6A:
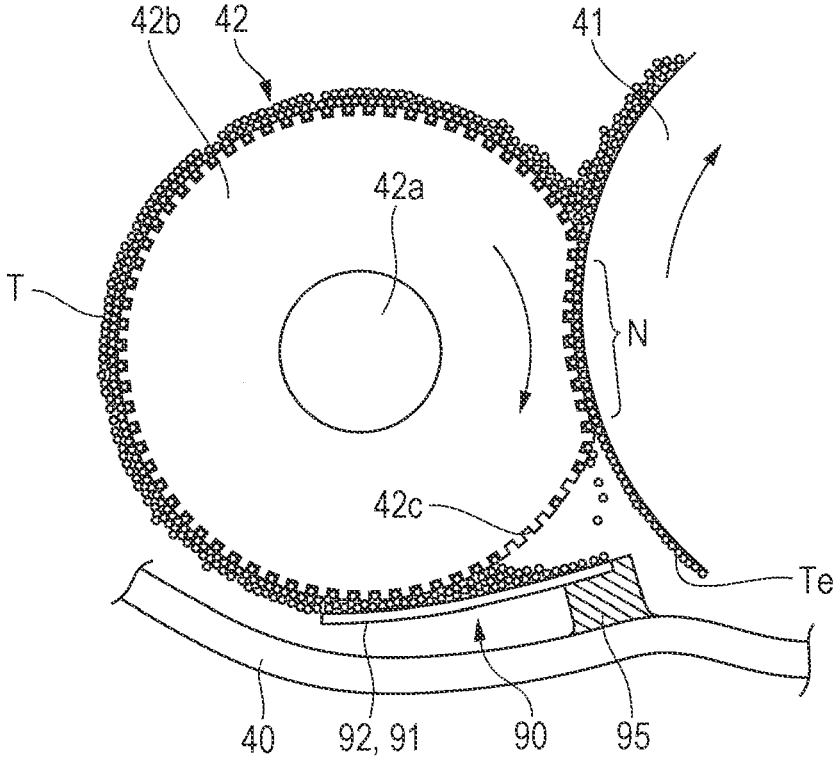
FIG. 6A illustrates the behavior of toner in a region around a contact region between a feeding roller and a developing roller.
Figure 6B:
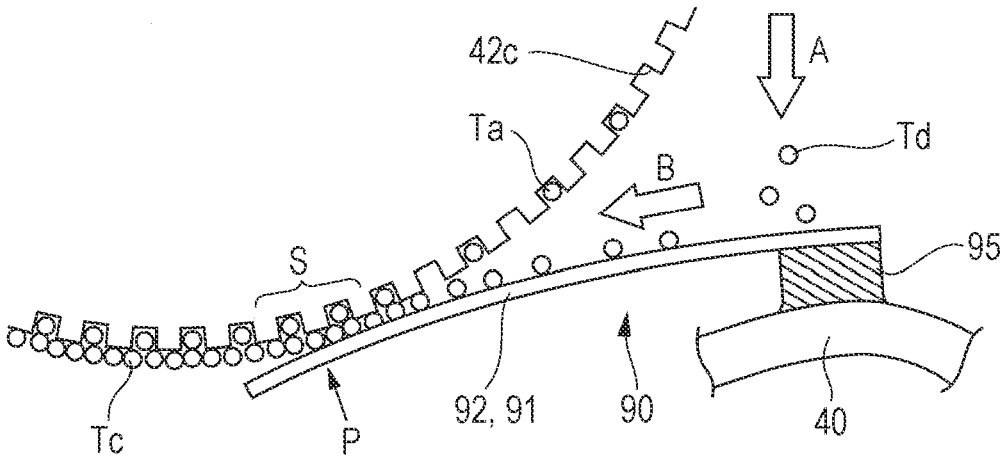
FIG. 6B illustrates the behavior of released toner.

The released toner Td (see FIG. 6B) that falls from the contact region N between the developing roller 41 and the feeding roller 42 is attached to the feeding roller 42 by the attaching mechanism 90, and is re-transported by the rotation of the feeding roller 42 while being captured by the feeding roller 42 together with remaining toner Ta that has remained on the feeding roller 42 (see FIG. 6B).

Figure 7A:
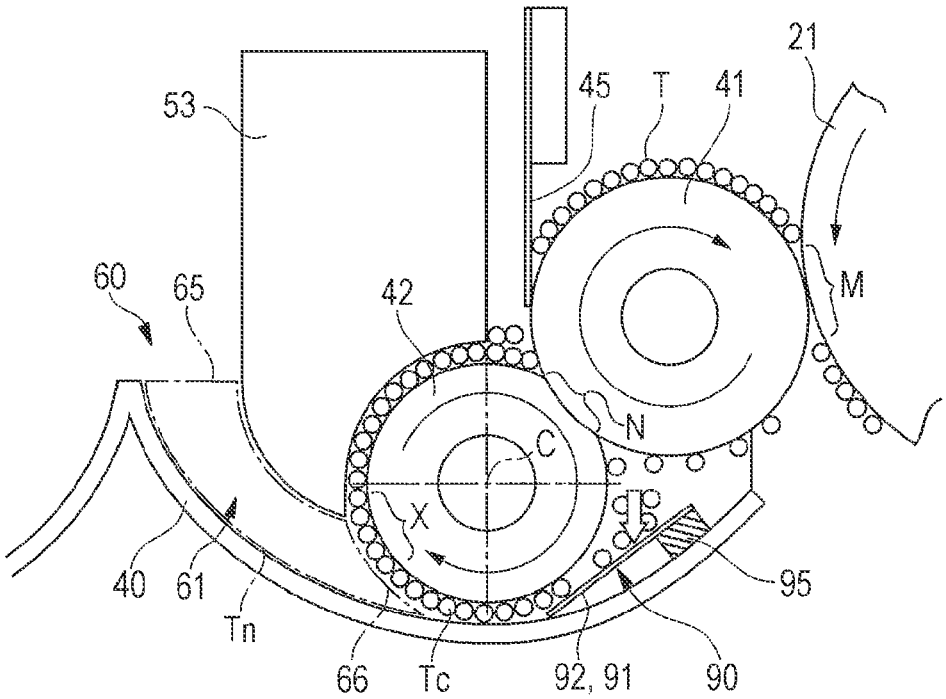
FIG. 7A illustrates the behavior of toner in a region around a new-toner supply region.
Figure 7B:
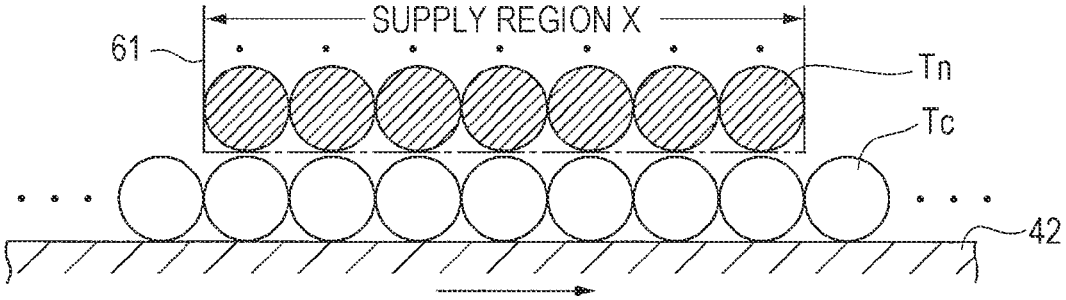
FIG. 7B illustrates the behavior of toner in the new-toner supply region in the case where a sufficient amount of re-transported toner (old toner) is captured by the feeding roller.
Figure 7C:
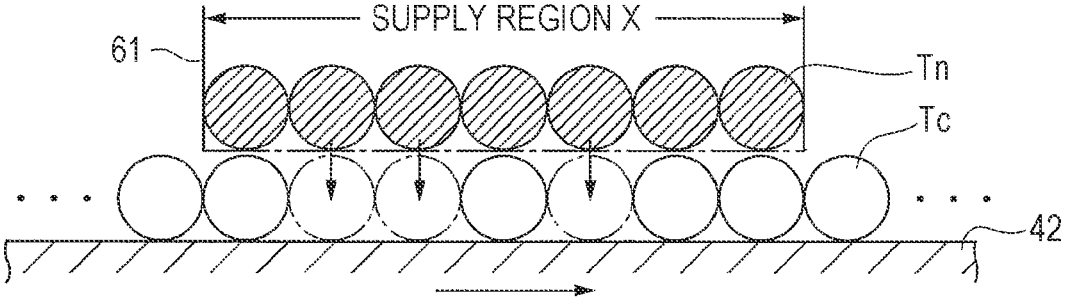
FIG. 7C illustrates the behavior of toner in the new-toner supply region in the case where the amount of re-transported toner (old toner) captured by the feeding roller is insufficient.

When the amount of toner captured on the peripheral surface of the feeding roller 42 becomes insufficient, the toner supplying mechanism 60 supplies the new toner Tn to the peripheral surface of the feeding roller 42 as appropriate (see FIGS. 7A to 7C).

The developing device 24 performs the developing process in the above-described manner.

Behavior of Toner Around Attaching Mechanism

Behavior of the toner around the attaching mechanism 90 in the developing process performed by the developing device 24 will now be described.

As illustrated in FIG. 6A, since the feeding roller 42 includes the elastic layer 42*b* formed of, for example, a foamed material, the feeding roller 42 is deformed along the surface of the developing roller 41 in the contact region N between the developing roller 41 and the feeding roller 42. The deformed portion returns to its original shape after leaving the contact region N. The linear velocity of the peripheral surface of the feeding roller 42 increases when the deformed portion returns to its original shape after leaving the contact region N, and a repulsive force is generated when the deformed portion of the elastic layer 42*b* returns to its original shape. Accordingly, some of the toner T captured by the rough surface 42*c* at the periphery of the feeding roller 42 is released.

The remaining unused toner Te that has not been used in the developing region M of the developing roller 41 is transported to the contact region N by the rotation of the developing roller 41. The remaining unused toner Te held by the developing roller 41 is scraped off and falls at an upstream position of the contact region N in the rotation direction of the developing roller 41 (downstream position in the rotation direction of the feeding roller 42).

The released toner Td that falls from the contact region N as described above travels as shown by arrow A in FIG. 6B, and is received by the elastic sheet 92 that functions as the guide member 91, which is an element of the attaching mechanism 90.

In this state, the elastic sheet 92 has the smooth surface 93 at the front side and is inclined so that the pressed portion S that is pressed against the feeding roller 42 is below the portion that receives the released toner Td. Therefore, as shown by arrow B in FIG. 6B, particles of the released toner Td received by the elastic sheet 92 roll along the inclined smooth surface 93 of the elastic sheet 92 and move toward the pressed portion S that is pressed against the feeding roller 42.

A contact force P applied to the pressed portion S of the elastic sheet 92 gradually increases toward the end of the elastic sheet 92 in accordance with the curvature of the peripheral surface of the feeding roller 42. Therefore, the released toner Td that has moved along the surface of the elastic sheet 92 and reached the pressed portion S of the elastic sheet 92 is gradually pressed and triboelectrically charged between the elastic sheet 92 and the feeding roller 42. Then, the released toner Td is captured by the feeding roller 42 together with the remaining toner Ta that has remained on the rough surface 42*c* at the periphery of the feeding roller 42.

The contact force P applied to the elastic sheet 92 is substantially uniformly distributed over the pressed portion S in the axial direction of the feeding roller 42. Therefore, the amount of transportation of the toner at the peripheral surface of the feeding roller 42 is reliably determined by the elastic sheet 92, and is uniform in the axial direction. Therefore, the released toner Td is pressed against the feeding roller 42 together with the remaining toner Ta by the contact force P applied by the elastic sheet 92, and is attached to the peripheral surface of the feeding roller 42 by the image force of the toner. As a result, old toner Tc, which includes the remaining toner Ta and the released toner Td, is captured on the peripheral surface of the feeding roller 42 when it passes the pressed portion S of the elastic sheet 92, and is re-transported by the rotation of the feeding roller 42.

Most of the released toner Td is attached to the peripheral surface of the feeding roller 42. Therefore, the released toner Td is prevented from collecting in a region below the contact region N in the developing chamber 51.

Behavior of Toner Around Toner Supplying Mechanism

Behavior of New Toner and Old Toner in Supply Region

In the above-described manner, the old toner Tc, which is not the new toner Tn, is re-transported by the feeding roller 42 and reaches the supply region X of the toner supplying mechanism 60, as illustrated in FIG. 7A.

In this example, the toner supplying mechanism 60 includes the curve-shaped toner transport path 61 that connects the containing chamber 52 to the developing chamber 51. The developing-chamber-side opening 66 of the toner transport path 61 is arranged so as to face the feeding roller 42, and is positioned below the containing-chamber-side opening 65 of the toner transport path 61.

Therefore, a substantially constant amount of new toner Tn is retained in the toner transport path 61 so as to fill the toner transport path 61, and the developing-chamber-side opening 66 receives a pressing force generated by the weight of the new toner Tn retained in the toner transport path 61 (shown by one-dot chain lines in FIG. 7A). Accordingly, an interface is formed between the toner in the developing chamber 51 and the new toner Tn retained in the toner transport path 61.

Although the new toner Tn contained in the containing chamber 52 is transported to the toner transport path 61 by the agitator 62, the toner transport path 61 is already filled with the new toner Tn. Therefore, the amount of new toner Tn retained in the toner transport path 61 is substantially constant.

In this example, the developing-chamber-side opening 66 of the toner transport path 61 is positioned below the center C of the feeding roller 42. In addition, the toner transport path 61 has a curved shape and a portion thereof near the developing-chamber-side opening 66 extends laterally and slightly downward toward the developing-chamber-side opening 66.

The layer of the old toner Tc captured by the feeding roller 42 is formed around the feeding roller 42, and is moved along the developing-chamber-side opening 66 of the toner transport path 61 by the rotation of the feeding roller 42.

In the region in which the feeding roller 42 faces the developing-chamber-side opening 66, the feeding roller 42 rotates so as to move upward and approach the toner transport path 61. Therefore, the direction in which the feeding roller 42 is pressed by the new toner Tn through the developing-chamber-side opening 66 of the toner transport path 61 is opposite to the rotation direction of the feeding roller 42. In addition, the old toner Tc that has been attached to the feeding roller 42 in a smooth state by the attaching mechanism 90 is re-transported by the feeding roller 42. Therefore, in the developing-chamber-side opening 66, the old toner To on the feeding roller 42 is moved along the interface of the new toner Tn retained in the toner transport path 61 while the old toner To is suppressed from being mixed with the new toner Tn.

In the present exemplary embodiment, if, for example, the developing-chamber-side opening 66 of the toner transport path 61 extends to a region above the center C of the feeding roller 42, the feeding roller 42 rotates so as to move away from the toner transport path 61 in the region above the center C of the feeding roller 42. Therefore, the new toner Tn that is positioned at the interface of the new toner Tn retained in the toner transport path 61 is easily extracted by the rotation of the feeding roller 42, and is easily mixed into the toner on the feeding roller 42. To avoid such a situation, the above-described configuration of the present exemplary embodiment may be applied.

Also when the feeding roller 42 is rotated in the opposite direction (direction in which a portion of the feeding roller 42 that faces the developing-chamber-side opening 66 moves downward), the above-described configuration of the present exemplary embodiment may be applied to avoid a situation in which the new toner Tn at the interface of the new toner Tn retained in the toner transport path 61 is easily extracted by the rotation of the feeding roller 42 and mixed into the toner on the feeding roller 42.

Old-Toner-Capturing State of Feeding Roller I (Sufficient)

As illustrated in FIG. 7B, in the case where a sufficient amount of old toner Tc, which is the re-transmitted toner, is captured by the feeding roller 42, there is no space for receiving additional toner on the peripheral surface of the feeding roller 42. Therefore, the new toner Tn retained in the toner transport path 61 is not easily captured on the peripheral surface of the feeding roller 42.

In addition, since the new toner Tn retained in the toner transport path 61 presses the peripheral surface of the feeding roller 42, the old toner Tc captured by the feeding roller 42 is blocked by the interface of the new toner Tn retained in the toner transport path 61, and is prevented from being mixed into the new toner Tn in the toner transport path 61.

Old-Toner-Capturing State of Feeding Roller II (Insufficient)

As illustrated in FIG. 7C, in the case where the amount of old toner Tc, which is the re-transmitted toner, captured by the feeding roller 42 is insufficient, the new toner Tn is supplied to the feeding roller 42 in regions where the old toner Tc is not captured since the peripheral surface of the feeding roller 42 is pressed by the weight of the new toner Tn retained in the toner transport path 61.

As described above, the new toner Tn is not supplied to the feeding roller 42 when a sufficient amount of old toner Tc is captured, and is supplied when the amount of old toner Tc becomes insufficient. Therefore, the old toner Tc and the new toner Tn are prevented from being unnecessarily mixed at the peripheral surface of the feeding roller 42, and the old toner Tc is preferentially used.

Regulation of Amount of Toner Captured by Feeding Roller

In the present exemplary embodiment, there is a risk that the toner surrounding the old toner Tc captured on the peripheral surface of the feeding roller 42 will move together with the old toner Tc owing to viscosity or the like when the feeding roller 42 rotates.

However, in the present exemplary embodiment, the regulating surface 70, which has a curved shape and extends along the peripheral surface of the feeding roller 42 with the predetermined gap g therebetween, is formed on the partition member 53 in a region adjacent to the developing-chamber-side opening 66 of the toner transport path 61. Therefore, even when, for example, excess toner tries to move together with the toner captured at the periphery of the feeding roller 42 in the developing-chamber-side opening 66 of the toner transport path 61 or in the region where the feeding roller 42 faces the bottom wall of the developing container 40, the excess part of the toner captured on the peripheral surface of the feeding roller 42 is scraped off when the toner passes the regulating surface 70 of the partition member 53. Thus, the amount of toner captured by the feeding roller 42 is regulated to a desired amount.

Comparative Exemplary Embodiment 1

To evaluate the performance of the developing device according to the first exemplary embodiment, the performance of a developing device according to comparative exemplary embodiment 1 will be described.

Figure 8:
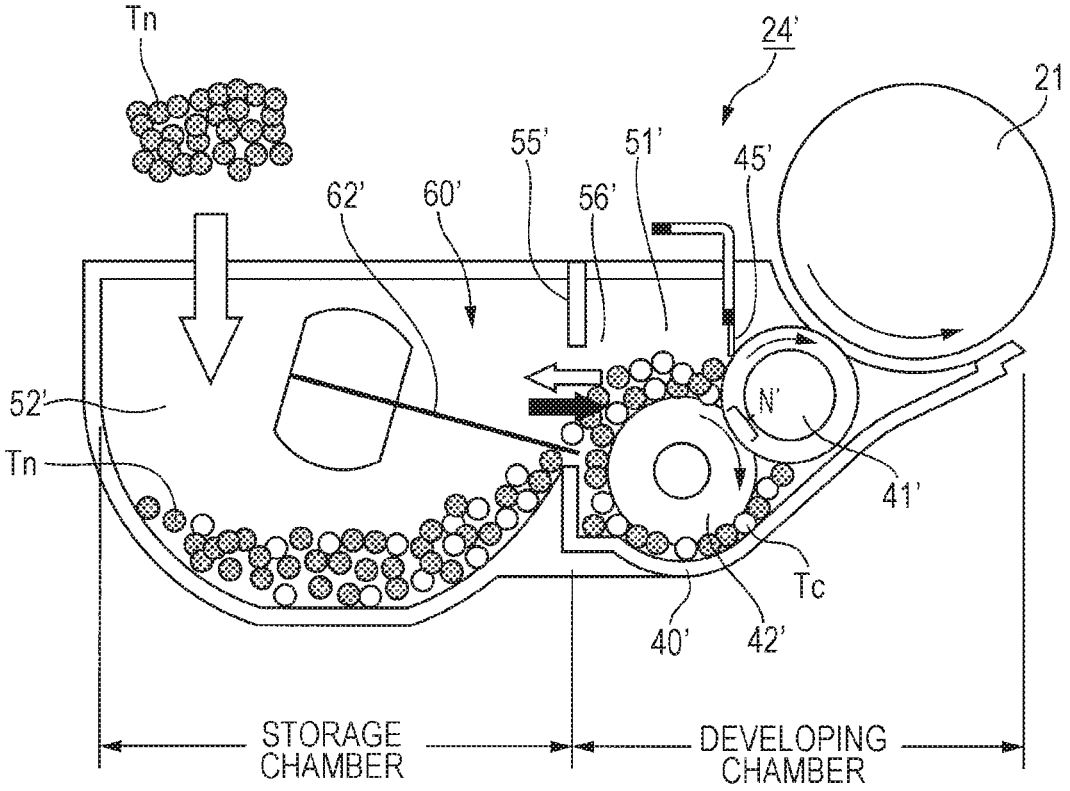
FIG. 8 RELATED ART
FIG. 8 illustrates a developing device according to comparative exemplary embodiment 1.

FIG. 8 illustrates a developing device 24' according to comparative exemplary embodiment 1.

Referring to FIG. 8, the developing device 24' includes a separating wall 55' that is arranged in a developing container 40' so as to separate a developing chamber 51' and a containing chamber 52' that contains new toner Tn from each other. The separating wall 55' has a toner transporting hole 56' formed therein. The developing chamber 51' houses a developing roller 41', a feeding roller 42', and a charging blade 45'. The containing chamber 52' houses an agitator 62' that functions as a toner supplying mechanism 60'. The developing device 24' does not include the "partition member 53 having the regulating surface 70", the "toner transport path 61 that retains the new toner", and the "attaching mechanism 90", which are included in the developing device 24 according to the first exemplary embodiment.

The operation of the present comparative exemplary embodiment will now be described.

When the agitator 62' starts a toner supplying operation, the new toner Tn contained in the containing chamber 52' is supplied to the developing chamber 51' through the toner transporting hole 56'. When the amount of toner in the developing chamber 51' increases and the height of the toner exceeds the height of the toner transporting hole 56', old toner Tc flows backward into the containing chamber 52' from the developing chamber 51'.

In addition, released toner that has been released at a contact region N' between the developing roller 41' and the feeding roller 42' is collected in the developing chamber 51'. The collected toner receives frictional stress from the feeding roller 42' without being consumed, and becomes mixed with the new toner Tn.

When the new toner Tn and old toner Tc are mixed in the developing chamber 51', the new toner Tn and the old toner Tc have very different coating levels because an external additive added to the old toner Tc becomes separated from or embedded into particle bases of the toner. Therefore, when the new toner Tn and the old toner Tc are mixed, mutual charging is caused by the charging blade 45' and the charge distribution significantly differs between the new toner Tn and the old toner Tc. As a result, improperly charged toner particles are easily generated, and a fogging phenomenon easily occurs in which the improperly charged toner particles unnecessarily adhere to the recording medium in, for example, a background area.

As described above, in comparative exemplary embodiment 1, the new toner Tn and the old toner Tc are unavoidably mixed on the feeding roller 42'. In contrast, in the first exemplary embodiment, the toner supplying mechanism 60 that retains the new toner Tn and the attaching mechanism 90 are used so that the disadvantage of the developing device 24 according to comparative exemplary embodiment 1 may be reduced.

Toner Ejection Control

In the present exemplary embodiment, the control device 100 performs a toner ejection control process in which the toner contained in the developing device 24 is forcedly ejected when the amount of toner consumption is smaller than a predetermined amount.

In the developing device 24 of the present example (see FIG. 3), if the amount of image output is small and the amount of toner consumption is too small, the toner on the feeding roller 42 and the remaining unused toner on the developing roller 41 repeatedly pass through the contact region N between the developing roller 41 and the feeding roller 42. Although some of the toner may become released, the released toner Td is attached to the feeding roller 42 again by the attaching mechanism 90 and is re-transported. Therefore, there is a possibility that the old toner Tc, which is not the new toner Tn, will be continuously rotated around the developing roller 41 and/or the feeding roller 42 instead of being consumed. In this state, the toner receives excessive stress, and an external additive added to the toner may, for example, become embedded into or separated from the toner particles. As a result, the charging characteristics and fluidity of the toner tend to vary. When the characteristics of the toner vary in this manner, background fogging may occur owing to a reduction in the amount of charge of the toner. In addition, the toner may become fixed to the charging blade 45 owing to a reduction in fluidity thereof, and image defects (for example, streaks) may occur as a result.

Figure 9:
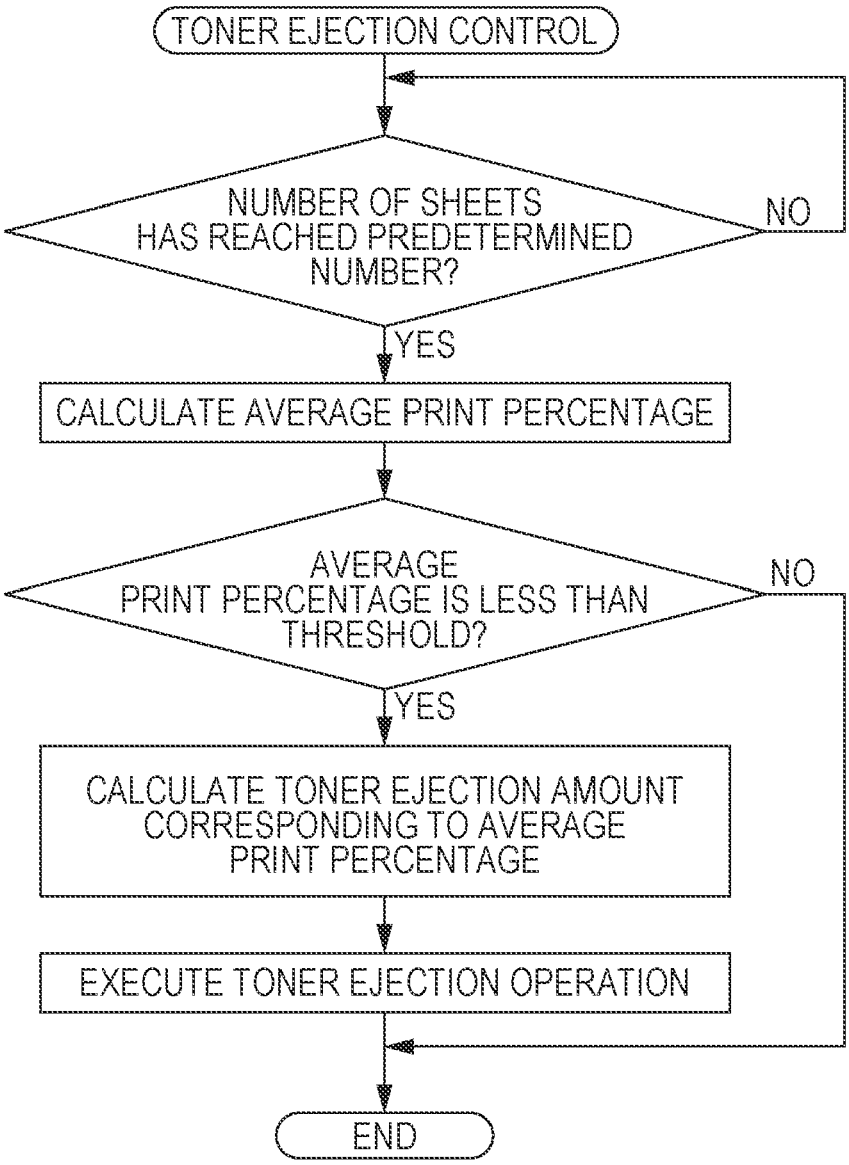
FIG. 9 is a flowchart of a toner ejection control process according to the first exemplary embodiment.

Accordingly, in the present exemplary embodiment, a toner ejection control process illustrated in FIG. 9 is performed.

In the toner ejection control process, as illustrated in FIG. 9, first, it is determined whether or not the number of sheets that have been output has reached a predetermined number, for example, 500. This step is repeated until the number of sheets reaches the predetermined number. When it is determined that the predetermined number of sheets has been reached, an average print percentage per sheet is calculated. The average print percentage per sheet is calculated by dividing the total number of dots (accumulated number of dots in an image area of each sheet) by the total area (product of the total number of dots in the image area and a non-image area of an image-forming area of each sheet and the number of sheets).

Next, it is determined whether or not the calculated average print percentage is smaller than a predetermined threshold. If it is determined that the calculated average print percentage is greater than or equal to the threshold, it is determined that the toner has been fairly consumed and there is no risk that degradation of the toner will occur. Then, the toner ejection control process is ended.

If it is determined that the average print percentage is not greater than or equal to the threshold, that is, if it is determined that the average print percentage is smaller than the threshold, it is determined that the toner is being degraded and a toner ejection amount corresponding to the average print percentage is calculated. The method for calculating the toner ejection amount is not particularly limited as long as the toner ejection amount for when the average print percentage is small is larger than that for when the average print percentage is large. For example, a computational expression showing the relationship between the average print percentage and the toner ejection amount may be prepared in advance, and the toner ejection amount may be determined by using this expression. Alternatively, several ranges may be set for the average print percentage, and toner ejection amounts corresponding to the respective ranges may be determined in advance.

After the toner ejection amount is calculated, a toner ejection operation is performed by controlling the charging device 22, the exposure device 23, the developing device 24, and the transfer device 25. More specifically, a toner-ejecting electrostatic latent image corresponding to the calculated toner ejection amount is formed on the photoconductor 21, and is then developed by the developing device 24. When the toner is ejected as described above, not only the toner on the developing roller 41 but also the toner attached to the feeding roller 42 is consumed. As a result, the old toner Tc that may have been degraded is removed from the developing device 24.

The toner that has been ejected onto the photoconductor 21 is removed by the cleaning device 26.

The toner ejection operation is performed at a time different from the time at which a normal image forming operation is performed. The toner ejection operation is appropriately performed when a normal image forming operation is not performed, for example, in a pause period in the image forming operation or when the image forming apparatus is activated or stopped. In the case where the toner on the photoconductor 21 is removed by the cleaning device 26 in the toner ejection operation, the operation of the transfer device 25 is stopped to prevent the toner on the photoconductor 21 from being transferred onto the transfer device 25. Alternatively, the transfer device 25 may be separated from the photoconductor 21 if the transfer device 25 is a contact-type transfer device, or an electric field that prevents the toner from adhering to the transfer device 25 may be applied between the transfer device 25 and the photoconductor 21. Although the toner that has been ejected onto the photoconductor 21 in the toner ejection operation is removed by the cleaning device 26 in this example, the toner may instead be transferred onto the recording medium 28 or be removed by another cleaning device.

In the present exemplary embodiment, the level of degradation of the toner is determined by calculating the average print percentage per each sheet from the accumulated amount of consumption of the toner when the number of sheets that have been output has reached the predetermined number. However, the method for determining the level of degradation of the toner is not limited to this, and the following method may instead be used.

That is, an amount of toner consumption per unit time may be calculated from the amount of toner consumption within a predetermined operation time of the developing device 24, and the level of degradation of the toner may be determined on the basis of whether or not the amount of toner consumption per unit time is greater than or equal to a predetermined threshold. In this case, the toner ejection operation may be performed when the amount of toner consumption per unit time is small.

Alternatively, the level of degradation of the toner may be determined on the basis of how long an output operation in which the amount of toner consumption per sheet is smaller than a predetermined threshold has continued. In general, when an image in which photographic images and character images are mixed is output, the average print percentage is high owing to the influence of the photographic images. In the case where the output image mainly includes character images and the area occupied by photographic images is small, an output operation with a small print percentage may be continuously performed. Accordingly, it may be recognized whether or not the state in which the amount of toner consumption per sheet is small continues, and when such a state continues for a long time, it may be determined that the toner may have been degraded and the toner ejection operation may be performed.

The level of degradation of the toner may also be determined in consideration of environmental conditions.

Modification of Attaching Mechanism

In the present exemplary embodiment, the attaching mechanism 90 includes the elastic sheet 92 as the guide member 91. One end of the elastic sheet 92 is fixed and the other end of the elastic sheet 92 is pressed against the peripheral surface of the feeding roller 42. However, the attaching mechanism 90 is not limited to this, and may be designed as in modifications 1-1 to 1-3 illustrated in FIGS. 10A to 10C, respectively.

Modification 1-1

Figure 10A:
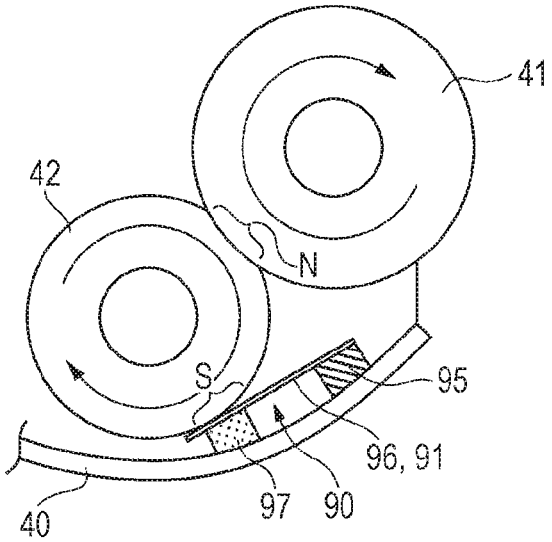
FIGS. 10A to 10C illustrate modifications of an attaching mechanism according to the first exemplary embodiment.

The attaching mechanism 90 illustrated in FIG. 10A includes a bendable sheet member 96 as the guide member 91. One end of the sheet member 96 is fixed to the attachment member 95, and the other end, which is a free end, of the sheet member 96 is pressed against the feeding roller 42. An urging member 97 that urges the sheet member 96 toward the feeding roller 42 is provided between a portion of the sheet member 96 corresponding to a pressed portion S that is pressed against the feeding roller 42 and the inner wall of the developing container 40. An elastic body or a leaf spring may be used as the urging member 97.

When the urging member 97 is used, the pressing conditions under which the sheet member 96 is pressed against the feeding roller 42 are maintained substantially constant. Accordingly, the released toner Td that has reached the pressed portion S of the sheet member 96 is attached to the feeding roller 42 at a stable contact force.

In modification 1-1, the elastic sheet 92 according to the first exemplary embodiment may be used as the sheet member 96. However, unlike the elastic sheet 92, it is not necessary that the sheet member 96 itself be pressed against the feeding roller 42. The sheet member 96 is not particularly limited as long as the sheet member 96 has a surface that allows particles of the released toner Td to roll therealong and is capable of being bent when pressed against the urging member 97, and may be formed of, for example, a leaf spring made of a metal (for example, SUS).

Modification 1-2

Figure 10B:
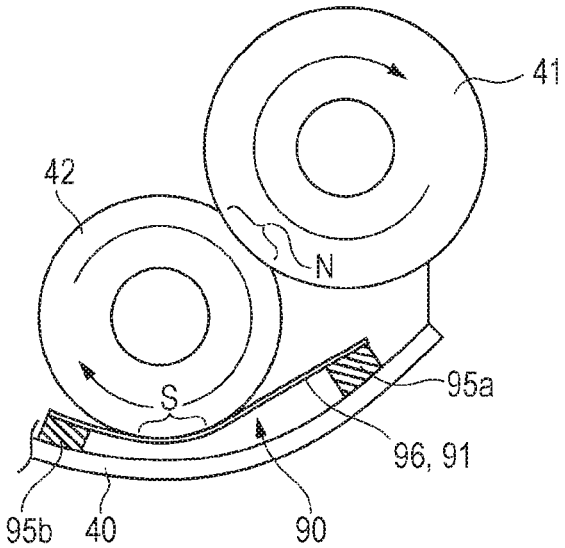

The attaching mechanism 90 illustrated in FIG. 10B includes a bendable sheet member 96 as the guide member 91. The sheet member 96 is arranged so as to face the feeding roller 42 and extend from the region below the contact region N between the feeding roller 42 and the developing roller 41 to a region opposite the region below the contact region N across the bottom portion of the feeding roller 42. Portions of the sheet member 96 near the ends thereof are fixed to respective attachment members 95 (95*a* and 95*b*) provided on the developing container 40, and an intermediate portion of the sheet member 96 is pressed against a portion of the feeding roller 42 near the bottom portion. The contact force applied by the sheet member 96 may be adjusted by using a material that is elastically deformable in a planar direction as the material of the sheet member 96 and adjusting the manner in which the sheet member 96 is stretched between the attachment members 95.

In this modification, the sheet member 96 extends beyond the bottom portion of the feeding roller 42, and therefore the area of the pressed portion S of the sheet member 96 that is pressed against the feeding roller 42 is relatively large. In this modification, a portion of the sheet member 96 that is upstream of the bottom portion of the feeding roller 42 in the rotation direction of the feeding roller 42 needs to be inclined downward from the portion that is positioned below the contact region N between the developing roller 41 and the feeding roller 42 and that receives the released toner toward the bottom portion of the feeding roller 42. Accordingly, the released toner Td received by the sheet member 96 is reliably pressed by the pressed portion S that is pressed against the feeding roller 42 when the released toner is attached to the feeding roller 42.

Modification 1-3

Figure 10C:
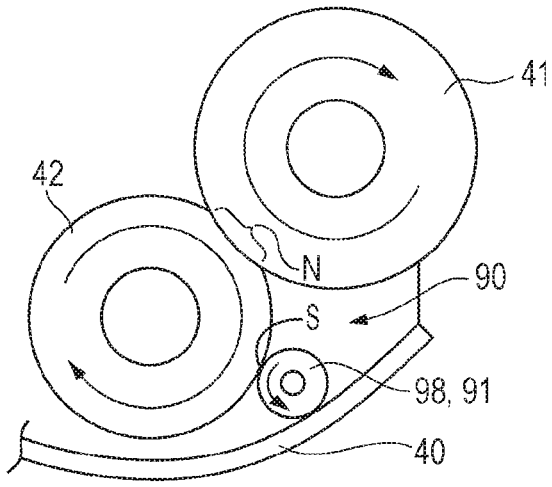

The attaching mechanism 90 illustrated in FIG. 10C includes a roller 98 having a smooth surface as the guide member 91. The roller 98 is arranged below the contact region N between the developing roller 41 and the feeding roller 42 such that the roller 98 is pressed against the peripheral surface of the feeding roller 42. The roller 98 is rotated by the rotation of the feeding roller 42.

In this example, a portion of the peripheral surface of the roller 98 that is closer to the feeding roller 42 than the top portion of the roller 98 is positioned so as to be able to receive the released toner Td that falls from the contact region N between the developing roller 41 and the feeding roller 42.

In this example, the roller 98 is rotated by the rotation of the feeding roller 42. Therefore, the released toner Td that has fallen from the contact region N and landed on the peripheral surface of the roller 98 is guided to a pressed portion S between the roller 98 and the feeding roller 42 and attached to the feeding roller 42.

Second Exemplary Embodiment

Figure 11A:
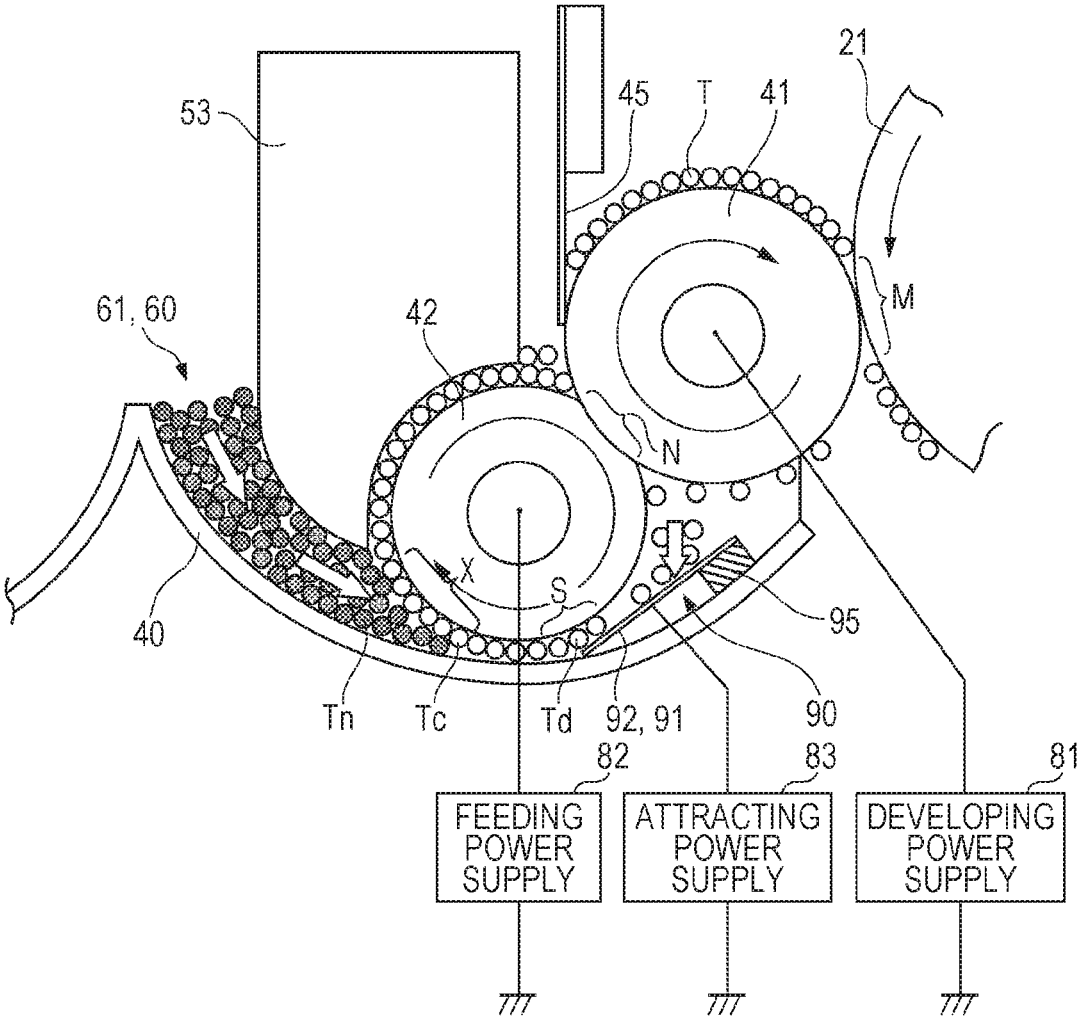
FIG. 11A illustrates a part of a developing device according to a second exemplary embodiment.

FIG. 11A illustrates a part of a developing device according to a second exemplary embodiment.

Referring to FIG. 11A, the developing device 24 has a basic structure similar to that in the first exemplary embodiment, but includes an attaching mechanism 90 different from that in the first exemplary embodiment. Components similar to those of the first exemplary embodiment are denoted by the same reference numerals, and detailed explanations thereof are thus omitted.

Similar to the first exemplary embodiment, the attaching mechanism 90 of this example includes an elastic sheet 92 having a cantilever structure as a guide member 91. The elastic sheet 92 is conductive, and is connected to an attracting power supply 83 capable of applying an attracting voltage for generating an attractive electric field in which toner T interposed between the elastic sheet 92 and a feeding roller 42 is attracted to the feeding roller 42.

In this example, an elastic sheet whose volume resistivity is adjusted to a predetermined value by, for example, dispersing a conductive filler may be used as the elastic sheet 92. The attractive electric field may be appropriately set so as to accelerate the adhesion of the toner T within a range in which unnecessary discharge does not occur between the feeding roller 42 and the elastic sheet 92 in consideration of the feeding voltage applied to the feeding roller 42.

Figure 11B:
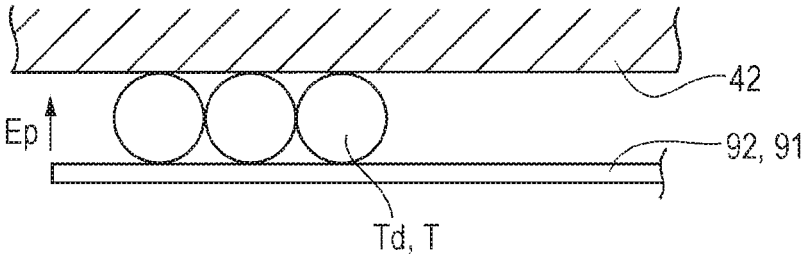
FIG. 11B illustrates an operation of the developing device according to the second exemplary embodiment.

In the present exemplary embodiment, as illustrated in FIGS. 11A and 11B, the attracting power supply 83 generates an attractive electric field Ep (electric field in which the elastic sheet 92 has the same polarity as the charge polarity of the toner T) that attracts the toner T to the feeding roller 42 between the feeding roller 42 and the elastic sheet 92. Therefore, the released toner Td (T) that has reached the pressed portion S of the elastic sheet 92 receives a force that attracts the toner to the feeding roller 42 from the generated electric field, and is strongly rubbed between the elastic sheet 92 and the feeding roller 42. Accordingly, the released toner Td on the elastic sheet 92 is more strongly charged, and is therefore more easily attached to the feeding roller 42. As a result, the released toner Td is stably held by the feeding roller 42, and the toner held by the feeding roller 42 is transported by the rotation of the feeding roller 42 to the supply region X of the toner supplying mechanism 60, that is, to the region in which the new toner Tn is supplied (region in which the feeding roller 42 faces the opening).

According to the present exemplary embodiment, the entire body of the elastic sheet 92 is conductive. However, the elastic sheet 92 is not limited to this, and may instead have a multilayer structure including a high-resistance layer having a volume resistivity of, for example, $10^9$ Ω·cm or more on the side facing the feeding roller 42 and a conductive layer on the opposite side. In this case, since the high-resistance layer is provided, the attracting voltage applied by the attracting power supply 83 may be higher than that in the case where the entire body of the elastic sheet 92 is conductive. In addition, dielectric polarization of the high-resistance layer easily occurs owing to the attracting power supply 83, and it may be expected that a force that attracts the elastic sheet 92 to the feeding roller 42 is also generated. In the present exemplary embodiment, the attaching mechanism 90 includes the elastic sheet 92 having a cantilever structure as the guide member 91. However, the guide member 91 is not limited to this, and may, of course, instead be structured as in the above-described modifications 1-1 to 1-3.

Third Exemplary Embodiment

Figure 12A:
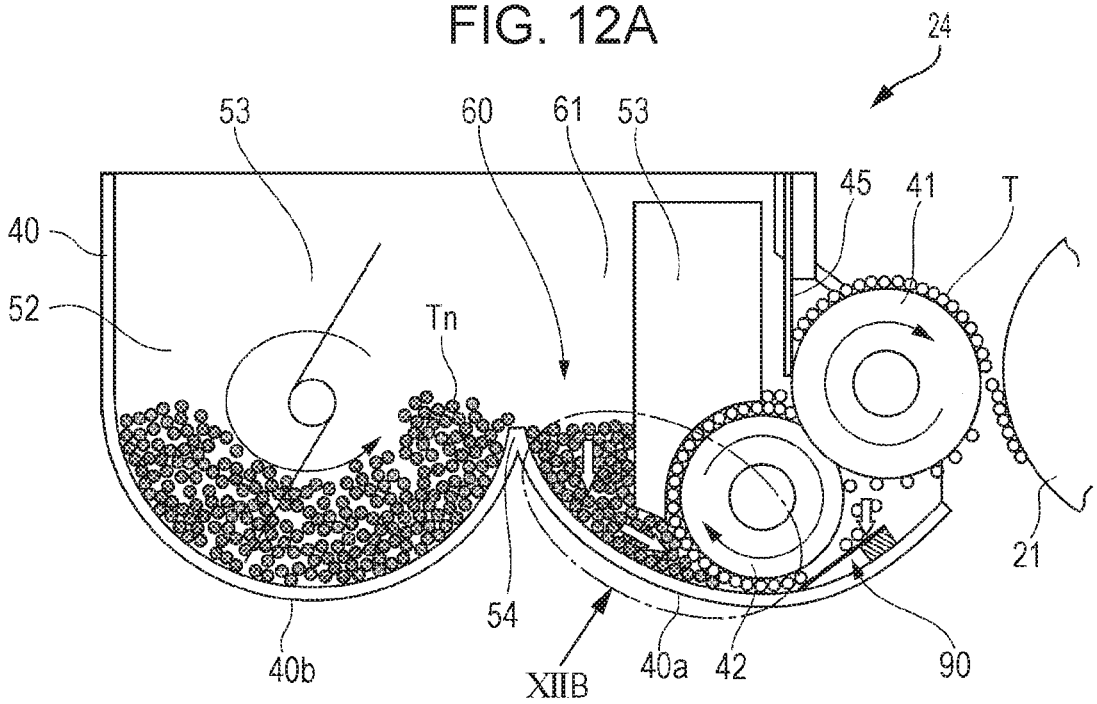
FIG. 12A illustrates a part of a developing device according to a third exemplary embodiment.

FIG. 12A illustrates a part of a developing device according to a third exemplary embodiment.

Referring to FIG. 12A, the developing device 24 has a basic structure similar to that in the first exemplary embodiment, but has a toner supplying mechanism 60 including a toner transport path 61 having a structure different from that in the first exemplary embodiment. Components similar to those of the first exemplary embodiment are denoted by the same reference numerals, and detailed explanations thereof are thus omitted.

Figure 12B:
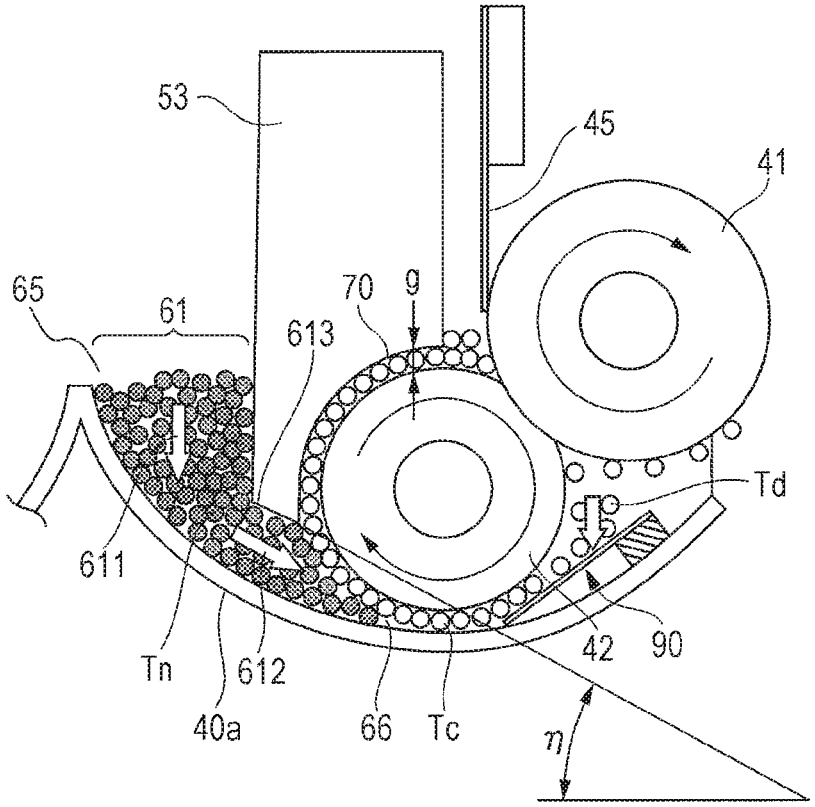
FIG. 12B illustrates the details of part XIIB illustrated in FIG. 12A.

As illustrated in FIGS. 12A and 12B, similar to the first exemplary embodiment, the toner transport path 61 according to the present exemplary embodiment includes a containing-chamber-side opening 65 and a developing-chamber-side opening 66 positioned below the containing-chamber-side opening 65. However, the toner transport path 61 has a shape different from that in the first embodiment, and includes a vertical passage 611 that extends in a substantially vertical direction and a lateral passage 612 that is bent from the vertical passage 611 and extends laterally toward the feeding roller 42.

In this example, the pressure applied to the peripheral surface of the feeding roller 42 at the interface (a type of a wall) of the new toner Tn retained in the toner transport path 61 increases as the height of the vertical passage 611 increases. When the vertical passage 611 is formed such that the cross sectional width thereof increases toward the top, the volume of the new toner Tn that fills the vertical passage 611 increases. Also in this case, the pressure applied at the interface of the new toner Tn retained in the toner transport path 61 increases.

The lateral passage 612 is bent from the vertical passage 611 in a desired direction and extends so that the interface is formed by the new toner Tn retained in the toner transport path 61 at a position where the lateral passage 612 faces the peripheral surface of the feeding roller 42.

The toner transport path 61 is defined between a partition member 53 and a curved portion 40*a*, which is a portion of a bottom wall of a developing container 40. A wall of the partition member 53 that defines the top surface of the lateral passage 612 is inclined downward from the vertical passage 611 toward the feeding roller 42. An inclination angle η of the wall with respect to the horizontal direction is smaller than or equal to an angle of repose of the toner that is used.

The angle of repose of the toner is an index of fluidity of the toner. In the present exemplary embodiment, the inclination angle η of the top wall of the lateral passage 612 with respect to the horizontal direction is smaller than or equal to the angle of repose of the toner that is used. Therefore, the new toner Tn that fills the lateral passage 612 does not easily flow and serves to reduce the excessive pressure applied by the new toner Tn in the vertical passage 611. The supply pressure of the new toner Tn applied to the feeding roller 42 may be adjusted by adjusting the combination of the height of the vertical passage 611, the length of the lateral passage 612, and the inclination angle η.

In the present exemplary embodiment, a corner portion 613 of the partition member 53 at which the lateral passage 612 is bent from the vertical passage 611 has an angular shape. However, to reduce the resistance against the movement of the new toner Tn from the vertical passage 611 to the lateral passage 612, the corner portion 613 may instead have a curved shape.

Fourth Exemplary Embodiment

Figure 13:
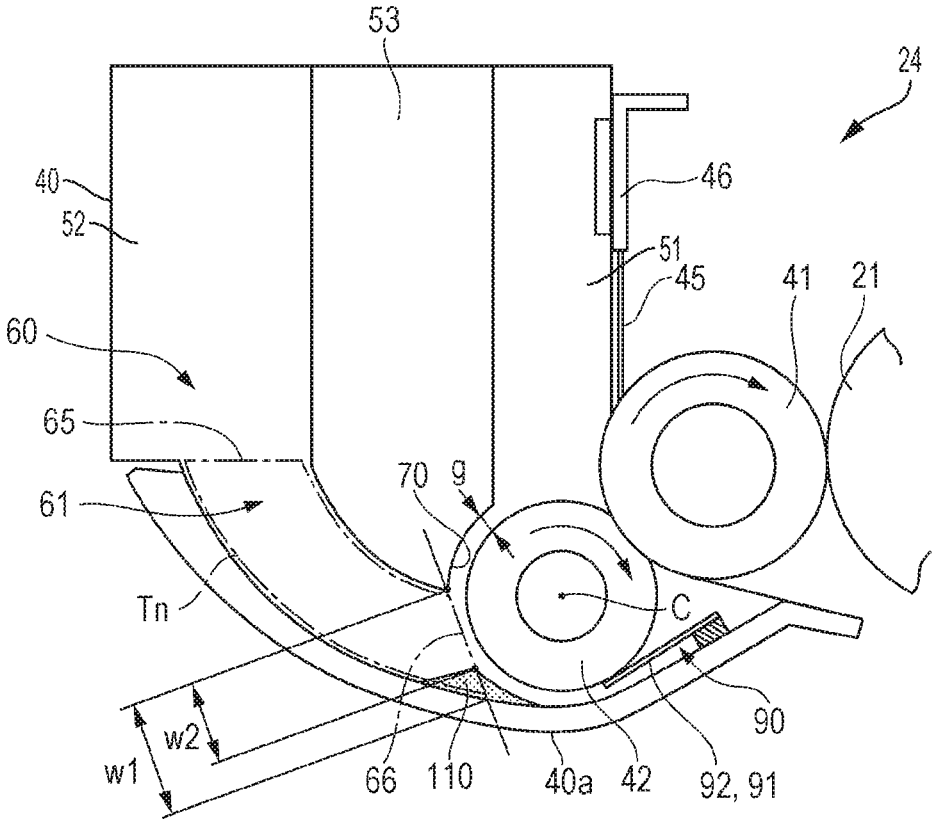
FIG. 13 illustrates a part of a developing device according to a fourth exemplary embodiment.

FIG. 13 illustrates a part of a developing device according to a fourth exemplary embodiment.

Referring to FIG. 13, the developing device 24 has a basic structure similar to that in the first exemplary embodiment, but has a toner supplying mechanism 60 including a toner transport path 61 having a structure that is partially different from that in the first exemplary embodiment. Components similar to those of the first exemplary embodiment are denoted by the same reference numerals, and detailed explanations thereof are thus omitted.

In this example, similar to the first exemplary embodiment, the toner transport path 61 is formed between a partition member 53 and a curved portion 40*a*, which is a portion of the bottom wall of the developing container 40. The toner transport path 61 has a containing-chamber-side opening 65 that is positioned above a developing-chamber-side opening 66, and is curved from a containing chamber 52 toward a developing chamber 51 along the curved portion 40*a*.

A width w1 of the developing-chamber-side opening 66 of the toner transport path 61 along a rotation direction of a feeding roller 42 is smaller than the outer diameter d (see FIG. 5) of the feeding roller 42 in a plane of projection in a direction from the feeding roller 42. Unlike the first exemplary embodiment, the developing-chamber-side opening 66 extends to a position above the center C of the feeding roller 42. Similar to the first exemplary embodiment, the partition member 53 has a curved regulating surface 70 in a region adjacent to the developing-chamber-side opening 66. The regulating surface 70 faces the feeding roller 42 and extends along the peripheral surface of the feeding roller 42 with a gap g therebetween.

In the present exemplary embodiment, similar to the first exemplary embodiment, the new toner Tn retained in the toner transport path 61 is pressed in a slightly downwardly inclined direction at the developing-chamber-side opening 66. In the region in which the feeding roller 42 faces the developing-chamber-side opening 66, the old toner Tc (not illustrated in FIG. 13) captured by the feeding roller 42 moves upward and comes into contact with the new toner Tn.

When the new toner Tn and the old toner repeatedly come into contact with each other over time, a location at which the old toner Tc (not illustrated in FIG. 13) captured by the feeding roller 42 joins the new toner Tn retained in the toner transport path 61 is generated near the bottom edge of the developing-chamber-side opening 66 of the toner transport path 61. In this case, since the pressing force based on the weight of the new toner Tn retained in the toner transport path 61 is applied to the peripheral surface of the feeding roller 42 and the new toner Tn retained in the toner transport path 61 is pressed by the rotational force of the old toner Tc (not illustrated in FIG. 13) captured by the feeding roller 42, the new toner Tn and the old toner gradually collect at the location where they join and solidify in a soft-blocking fashion. As a result, a substantially triangular toner wall 110 made of toner that has collected (so-called dead toner) is formed.

When the toner wall 110 is formed near the bottom edge of the developing-chamber-side opening 66 of the toner transport path 61 over time, the old toner Tc (not illustrated in FIG. 13) captured by the feeding roller 42 comes into contact with the toner wall 110 immediately after reaching the developing-chamber-side opening 66. Therefore, the old toner Tc (not illustrated in FIG. 13) is reliably prevented from flowing backward into the toner transport path 61.

When the toner wall 110 is formed as described above, the width of the developing-chamber-side opening 66 is substantially reduced from w1 to w2 (w2<w1). Therefore, the developing-chamber-side opening 66 may be designed in consideration of the formation of the toner wall 110.

Although the toner wall 110 is formed over time in the above-described example, a partition member corresponding to the toner wall 110 formed of the new toner Tn may, of course, instead be formed in the developing container 40.

In the present exemplary embodiment, the developing-chamber-side opening 66 of the toner transport path 61 extends to a position above the center C of the feeding roller 42. However, when the width w1 (or w2) of the developing-chamber-side opening 66 along the rotation of the feeding roller 42 is smaller than the outer diameter d of the feeding roller 42 in a plane of projection in a direction from the feeding roller 42, the new toner Tn retained in the toner transport path 61 comes into contact with the peripheral surface of the feeding roller 42 through the developing-chamber-side opening 66. Therefore, compared to the case in which the width of the developing-chamber-side opening 66 is greater than or equal to the outer diameter d of the feeding roller 42, the risk that the new toner Tn in the toner transport path 61 will be directly mixed into the developing chamber 51 may be reduced.

In particular, in this example, the partition member 53 has the predetermined regulating surface 70. Therefore, even when excess toner tries to move together with the toner captured on the peripheral surface of the feeding roller 42, the excess toner is removed by the regulating surface 70 of the partition member 53. Thus, the amount of toner that is captured on the peripheral surface of the feeding roller 42 is regulated by the regulating surface 70.

Fifth Exemplary Embodiment

Figure 14A:
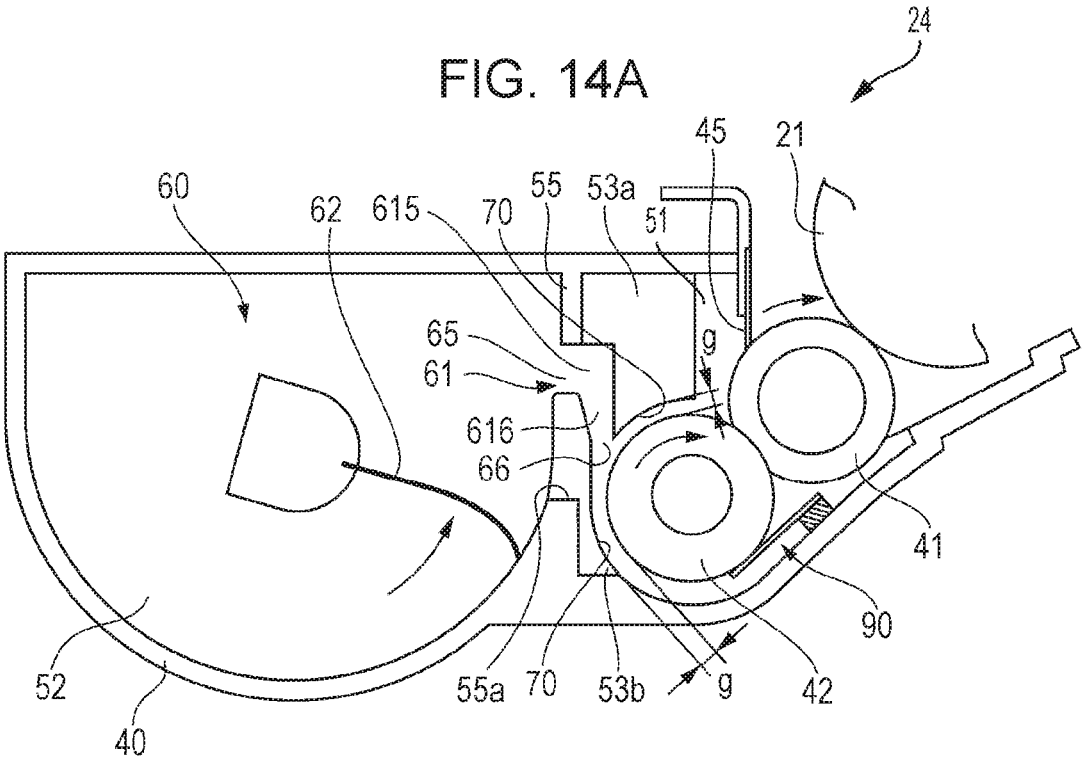
FIG. 14A illustrates a part of a developing device according to a fifth exemplary embodiment.

FIG. 14A illustrates a part of a developing device according to a fifth exemplary embodiment.

Referring to FIG. 14A, the developing device 24 has a basic structure similar to that in the first exemplary embodiment, but a partition structure between a toner supplying mechanism 60 and a developing chamber 51 differs from that in the first exemplary embodiment. Components similar to those of the first exemplary embodiment are denoted by the same reference numerals, and detailed explanations thereof are thus omitted.

In this example, a developing container 40 includes a separating wall 55 that separates a developing chamber 51 from a containing chamber 52 of new toner Tn (not illustrated in FIG. 14A), and an opening 55*a* is formed in the separating wall 55.

A downstream partition member 53*a* and an upstream partition member 53*b* are arranged near the opening 55*a* in the separating wall 55 in the developing chamber 51 of the developing container 40 at a downstream position and an upstream position, respectively, in a rotation direction of a feeding roller 42.

The upstream partition member 53*b* is attached to a portion of the separating wall 55 above the opening 55*a*, and is arranged so as to face the opening 55*a* and project toward the feeding roller 42.

The downstream partition member 53*a* is attached to a portion of the separating wall 55 below the opening 55*a*, and is arranged so as to face the feeding roller 42 and project into the opening 55*a*.

In this example, the toner supplying mechanism 60 includes a toner transport path 61 that is connected to the containing chamber 52, and an agitator 62 is disposed in the containing chamber 52. The toner transport path 61 is formed between the upstream partition member 53*b* and the downstream partition member 53*a*, and includes a lateral passage 615 that faces the containing chamber 52 and extends laterally in a substantially horizontal direction and a vertical passage 616 that is bent from the lateral passage 615 and extends in a substantially vertical direction toward the feeding roller 42. A developing-chamber-side opening 66, which corresponds to an outlet of the vertical passage 616, is disposed below a containing-chamber-side opening 65, which corresponds to an inlet of the lateral passage 615.

The width of the developing-chamber-side opening 66 along a rotation direction of the feeding roller 42 is at least smaller than the outer diameter of the feeding roller 42 in a plane of projection in a direction from the feeding roller 42. The position at which the developing-chamber-side opening 66 is formed may be set as appropriate. In this example, the developing-chamber-side opening 66 is formed at a position slightly above the center of the feeding roller 42.

In this example, each of the downstream partition member 53*a* and the upstream partition member 53*b* has a curved regulating surface 70 in a region adjacent to the developing-chamber-side opening 66 of the toner transport path 61. Each regulating surface 70 faces the feeding roller 42 and extends along the peripheral surface of the feeding roller 42 with a gap g therebetween. The gap g is not particularly limited as long as the toner layer to be formed on the feeding roller 42 may be regulated, and is in the range of 0.5 mm to 1.0 mm in this example. The meanings of the lower and upper limits are similar to those in the first exemplary embodiment.

The regions in which the regulating surfaces 70 are formed on the partition members 53*a* and 53*b* are not particularly limited. In this example, the regulating surface 70 of the downstream partition member 53*a* extends from the developing-chamber-side opening 66 of the toner transport path 61 to near the top portion of the feeding roller 42, and the regulating surface 70 of the upstream partition member 53*b* extends from the developing-chamber-side opening 66 of the toner transport path 61 to a location downstream of the bottom portion of the feeding roller 42 in the rotation direction of the feeding roller 42.

Figure 14B:
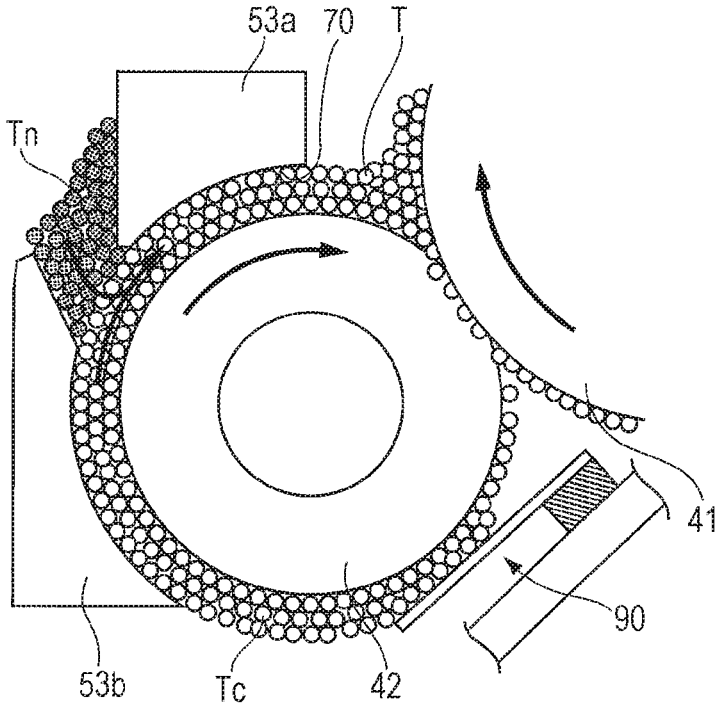
FIG. 14B illustrates the behavior of toner in a region around a feeding roller in the developing device according to the fifth exemplary embodiment.

In the toner supplying mechanism 60 according to the present exemplary embodiment, the agitator 62 transports the new toner Tn in the containing chamber 52 to the toner transport path 61, so that the new toner Tn is retained in the toner transport path 61 so as to fill the toner transport path 61 (see FIG. 14B).

Also in the present exemplary embodiment, the released toner is attached to the peripheral surface of the feeding roller 42 by an attaching mechanism 90, and the feeding roller 42 captures and re-transports the old toner Tc, which is not the new toner Tn. In this state, when the old toner Tc captured by the feeding roller 42 reaches the region in which the feeding roller 42 faces the developing-chamber-side opening 66 of the toner transport path 61, similar to the first exemplary embodiment, the peripheral surface of the feeding roller 42 is pressed by the weight of the new toner Tn retained in the toner transport path 61. Therefore, the interface of the new toner Tn retained in the toner transport path 61 serves as a type of a wall, and the old toner Tc captured by the feeding roller 42 is prevented from being mixed with the new toner Tn in the toner transport path 61 and is transported along the peripheral surface of the feeding roller 42. When a sufficient amount of old toner Tc is captured on the peripheral surface of the feeding roller 42, the new toner Tn is not supplied from the toner transport path 61. When the amount of old toner Tc captured on the peripheral surface of the feeding roller 42 is insufficient, the new toner Tn retained in the toner transport path 61 is supplied to the peripheral surface of the feeding roller 42 in regions where the old toner Tc is not captured.

In the present exemplary embodiment, as illustrated in FIG. 14B, each of the partition members 53*a* and 53*b* disposed on both sides of the developing-chamber-side opening 66 of the toner transport path 61 has the regulating surface 70 that regulates the amount of toner captured by the feeding roller 42. Therefore, only a part of the toner captured by the feeding roller 42 that is within a range determined by each regulating surface 70 is transported, and excess toner is removed by each regulating surface 70.

Therefore, in this example, the amount of old toner Tc that has been attached to the feeding roller 42 by the attaching mechanism 90 and re-transported is regulated by the regulating surface 70 of the upstream partition member 53*b*. The regulated amount of old toner Tc is moved along the developing-chamber-side opening 66 of the toner transport path 61 by the rotation of the feeding roller 42, and the amount of toner that passes the regulating surface 70 of the downstream partition member 53*a* is regulated by the regulating surface 70 of the downstream partition member 53*a*. Even when excessive new toner Tn tries to follow the peripheral surface of the feeding roller 42 in the region where the feeding roller 42 faces the developing-chamber-side opening 66, the excess toner is removed by the regulating surface 70.

As described above, in the present exemplary embodiment, the toner containing space in the developing chamber 51 is limited by the partition members 53*a* and 53*b*. When the toner containing space is limited substantially in correspondence with the amount of toner that may be transported by the feeding roller 42, there will be no space for toner that has received stress to scatter or collect in the developing chamber 51. The new toner Tn is not supplied as long as a sufficient amount of old toner Tc is captured on the peripheral surface of the feeding roller 42. Therefore, the old toner Tc and the new toner Tn are prevented from being unnecessarily mixed at the periphery of the feeding roller 42. As a result, broadening of the charge distribution obtained by the charging blade 45 due to unnecessary mixing of the new toner and the old toner may be avoided.

Sixth Exemplary Embodiment

Figure 15:
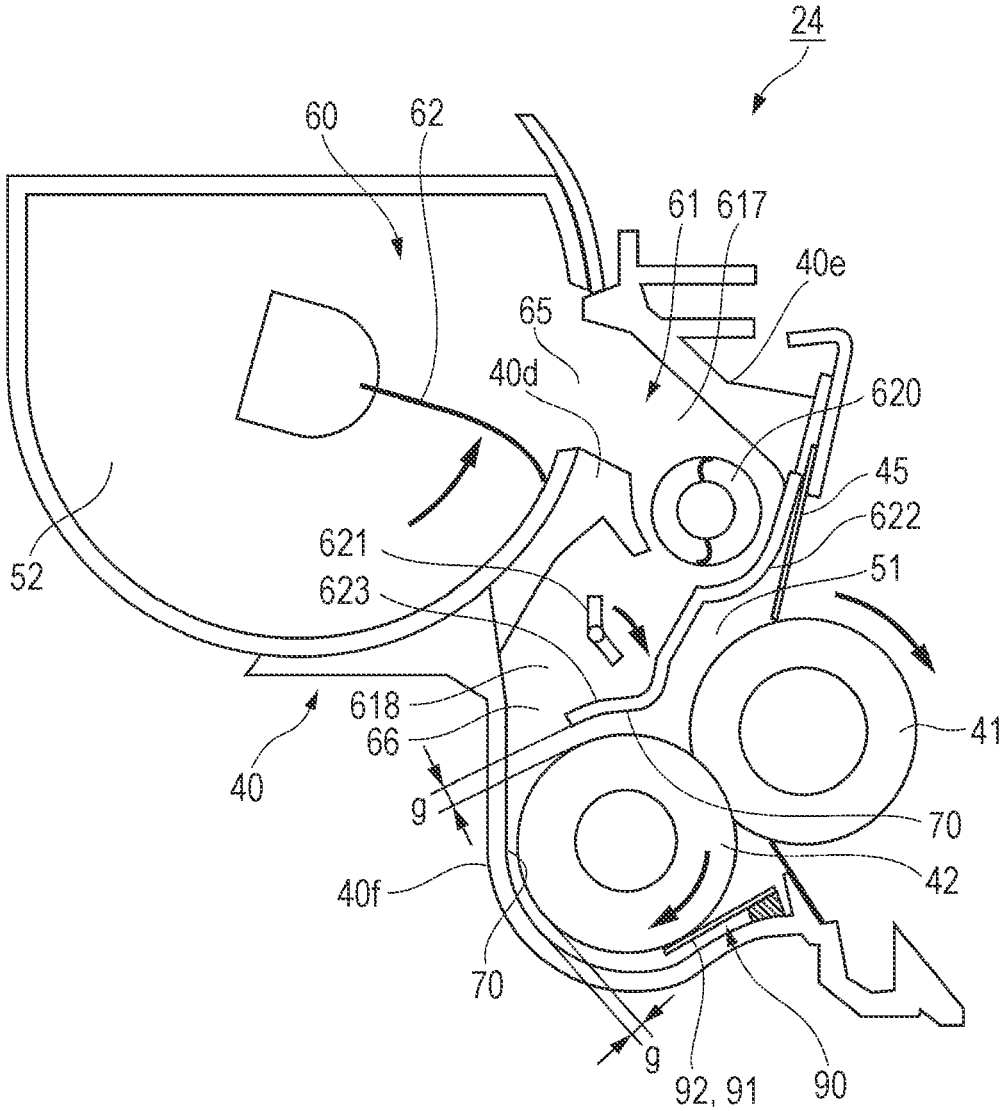
FIG. 15 illustrates a part of a developing device according to a sixth exemplary embodiment.

FIG. 15 illustrates a part of a developing device according to a sixth exemplary embodiment.

Referring to FIG. 15, the developing device 24 has a basic structure similar to that in the fifth exemplary embodiment. However, the shape of a developing container 40 and components of a toner supplying mechanism 60 and regulating surfaces 70 differ from those in the fifth exemplary embodiment. Components similar to those of the fifth exemplary embodiment are denoted by the same reference numerals, and detailed explanations thereof are thus omitted.

In the present exemplary embodiment, the developing container 40 includes a developing chamber 51 and a containing chamber 52 that contains new toner. Unlike the fifth exemplary embodiment, the new toner is supplied in a substantially vertical direction.

The toner supplying mechanism 60 includes a toner transport path 61 that connects the containing chamber 52 to the developing chamber 51, and an agitator 62 is disposed in the containing chamber 52.

In this example, the toner transport path 61 includes a first passage 617 that extends obliquely downward from a containing-chamber-side opening 65 and a second passage 618 that is bent from the first passage 617 and extends substantially vertically downward. A transport member 620, which includes a rotating shaft and helical blade members provided on the periphery of the rotating shaft in this example, is provided at a bent portion between the first passage 617 and the second passage 618. The transport member 620 transports the new toner that has been transported through the first passage 617 toward the second passage 618. A stirring agitator 621 is disposed at an intermediate position of the second passage 618, and a developing-chamber-side opening 66 is formed at the bottom of the second passage 618.

The toner transport path 61 is defined by passage-forming portions 40*d* and 40*e*, which are portions of peripheral walls of the developing container 40, and a passage-forming member 622 disposed in the developing container 40.

In this example, the passage-forming member 622 is arranged so as to face the passage-forming portion 40*d* and form the developing-chamber-side opening 66 between the passage-forming member 622 and the passage-forming portion 40*d*. In this example, the developing-chamber-side opening 66 is formed so as to face the feeding roller 42 at a location upstream of the top portion of the feeding roller 42 in a rotation direction of the feeding roller 42. The width of the developing-chamber-side opening 66 along the rotation direction of the feeding roller 42 is smaller than the outer diameter of the feeding roller 42 in a plane of projection in a direction from the feeding roller 42.

A facing wall 623 that faces the peripheral surface of the feeding roller 42 is formed integrally with the passage-forming member 622 in a region downstream of the developing-chamber-side opening 66 in the rotation direction of the feeding roller 42. The facing wall 623 has a curved regulating surface 70 that faces the feeding roller 42 and extends along the peripheral surface of the feeding roller 42 with a gap g therebetween.

In this example, a portion of a peripheral wall of the developing container 40 that faces the peripheral surface of the feeding roller 42 in a region upstream of the developing-chamber-side opening 66 in the rotation direction of the feeding roller 42 serves as a facing wall 40*f*. The facing wall 40*f* has a curved regulating surface 70 that faces the feeding roller 42 and extends along the peripheral surface of the feeding roller 42 with a gap g therebetween.

The gap g is not particularly limited as long as the toner layer to be formed on the feeding roller 42 may be regulated, and is in the range of 0.5 mm to 1.0 mm in this example. The meanings of the lower and upper limits are similar to those in the first exemplary embodiment.

In the toner supplying mechanism 60 according to the present exemplary embodiment, the agitator 62 transports the new toner in the containing chamber 52 to the toner transport path 61, and the transport member 620 transports the new toner that has been transported through the first passage 617 of the toner transport path 61 to the second passage 618. The stirring agitator 621 transports the new toner that has been transported to the second passage 618 toward the developing-chamber-side opening 66. Also in this example, the new toner is retained in the toner transport path 61 so as to fill the toner transport path 61.

In the present exemplary embodiment, similar to the fifth exemplary embodiment, the peripheral surface of the feeding roller 42 is pressed by the weight of the new toner retained in the toner transport path 61. Therefore, the interface of the new toner retained in the toner transport path 61 serves as a type of a wall, and the old toner captured by the feeding roller 42 is prevented from being mixed with the new toner in the toner transport path 61 and is transported along the peripheral surface of the feeding roller 42. When a sufficient amount of old toner is captured on the peripheral surface of the feeding roller 42, the new toner is not supplied from the toner transport path 61. When the amount of old toner captured on the peripheral surface of the feeding roller 42 is insufficient, the new toner retained in the toner transport path 61 is supplied to the peripheral surface of the feeding roller 42 in regions where the old toner is not captured.

In the present exemplary embodiment, the facing wall 623 of the passage-forming member 622 and the facing wall 40*f* that is a portion of the peripheral wall of the developing container 40 are provided on both sides of the developing-chamber-side opening 66 of the toner transport path 61, and are provided with the respective regulating surfaces 70 that regulate the amount of toner captured by the feeding roller 42. Therefore, only a part of the toner captured by the feeding roller 42 that is within a range determined by each regulating surface 70 is transported, and excess toner is removed by each regulating surface 70.

Therefore, in this example, the amount of old toner that has been attached to the feeding roller 42 by an attaching mechanism 90 and re-transported is regulated by the regulating surface 70 of the facing wall 40*f* that is a portion of the peripheral wall of the developing container 40. The regulated amount of old toner is moved along the developing-chamber-side opening 66 of the toner transport path 61 by the rotation of the feeding roller 42, and the amount of toner that passes the regulating surface 70 of the passage-forming member 622 is regulated by the regulating surface 70 of the passage-forming member 622. Even when excessive new toner tries to follow the peripheral surface of the feeding roller 42 in the region where the feeding roller 42 faces the developing-chamber-side opening 66, the excess toner is removed by the regulating surface 70.

Therefore, also in the present exemplary embodiment, similar to the fifth exemplary embodiment, the toner containing space in the developing chamber 51 is limited by the facing walls 40*f* and 623. When the toner containing space is limited substantially in correspondence with the amount of toner that may be transported by the feeding roller 42, there will be no space for toner that has received stress to scatter or collect in the developing chamber 51.

Seventh Exemplary Embodiment

Figure 16A:
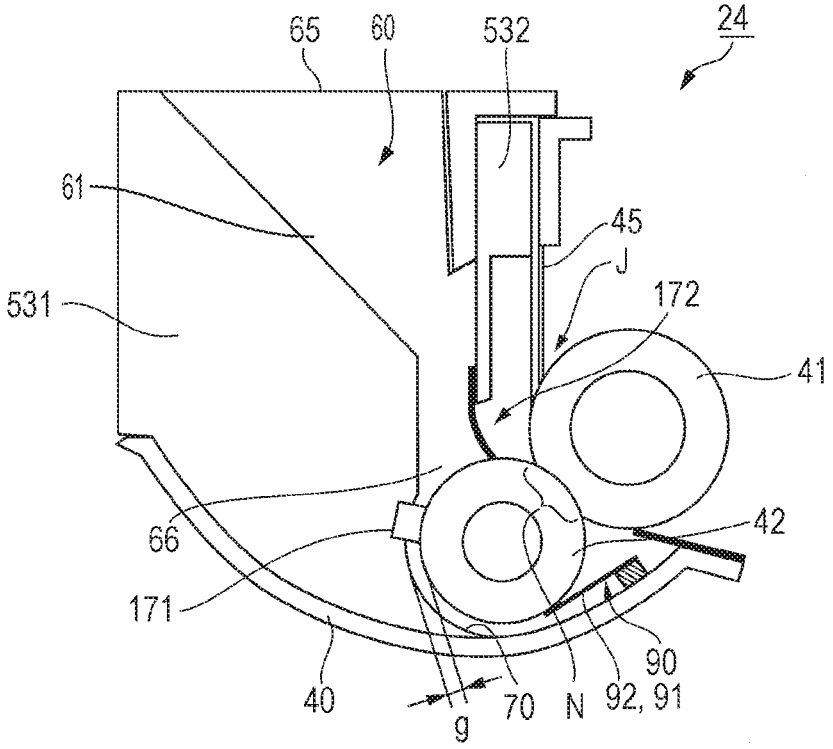
FIG. 16A illustrates a part of a developing device according to a seventh exemplary embodiment.

FIG. 16A illustrates a part of a developing device 24 according to a sixth exemplary embodiment.

Referring to FIG. 16A, the developing device 24 has a basic structure similar to that in the sixth exemplary embodiment. However, the structure between a toner supplying mechanism 60 and a feeding roller 42 differs from that in the sixth exemplary embodiment. Components similar to those of the sixth exemplary embodiment are denoted by the same reference numerals, and detailed explanations thereof are thus omitted.

Referring to FIG. 16A, the toner supplying mechanism 60 includes a toner transport path 61 that extends in a substantially vertical direction. A developing-chamber-side opening 66 is disposed below a containing-chamber-side opening 65, and is arranged so as to face the feeding roller 42. An agitator (not shown) transports new toner contained in a containing chamber (not shown) to the toner transport path 61, and the new toner that has been transported to the toner transport path 61 is retained in the toner transport path 61 so as to fill the toner transport path 61.

In this example, the developing-chamber-side opening 66 is arranged so as to face a portion of the feeding roller 42 above the center of the feeding roller 42 in a region from a location near the top portion of the feeding roller 42 to a location upstream of the top portion in a rotation direction of the feeding roller 42. The width of the developing-chamber-side opening 66 along the rotation direction of the feeding roller 42 is smaller than the outer diameter of the feeding roller 42 in a plane of projection in a direction from the feeding roller 42.

The toner transport path 61 is defined by a pair of partition members 531 and 532 which are disposed in the developing container 40. One partition member 531 has a curved regulating surface 70 that faces the feeding roller 42 and extends along the peripheral surface of the feeding roller 42 with a gap g therebetween. The gap g is not particularly limited as long as the toner layer to be formed on the feeding roller 42 may be regulated, and is in the range of 0.5 mm to 1.0 mm in this example. The meanings of the lower and upper limits are similar to those in the first exemplary embodiment.

In the present exemplary embodiment, first and second sealing members 171 and 172, which are made of elastic materials, are provided on the edges of the developing-chamber-side opening 66 of the toner transport path 61 along an axial direction of the feeding roller 42. The sealing members 171 and 172 are in elastic contact with the peripheral surface of the feeding roller 42. In this example, the first sealing member 171, which is on the upstream side in the rotation direction of the feeding roller 42, is a block of elastic rubber or the like that is pressed against the feeding roller 42. The second sealing member 172, which is on the downstream side in the rotation direction of the feeding roller 42, is made of, for example, an elastic sheet. The second sealing member 172 has an end fixed to the partition member 532 and a free end pressed against the feeding roller 42 along the movement direction. The contact forces applied to the sealing members 171 and 172 need to be set so that the toner to be captured by the feeding roller 42 is prevented from being scraped off.

To evaluate the performance of the developing device 24 according to the present exemplary embodiment, a developing device of comparative exemplary embodiment 7-1 (see FIG. 16B) which does not include the sealing members 171 and 172 will be considered and performances of the two developing devices will be compared.

Figure 16B:
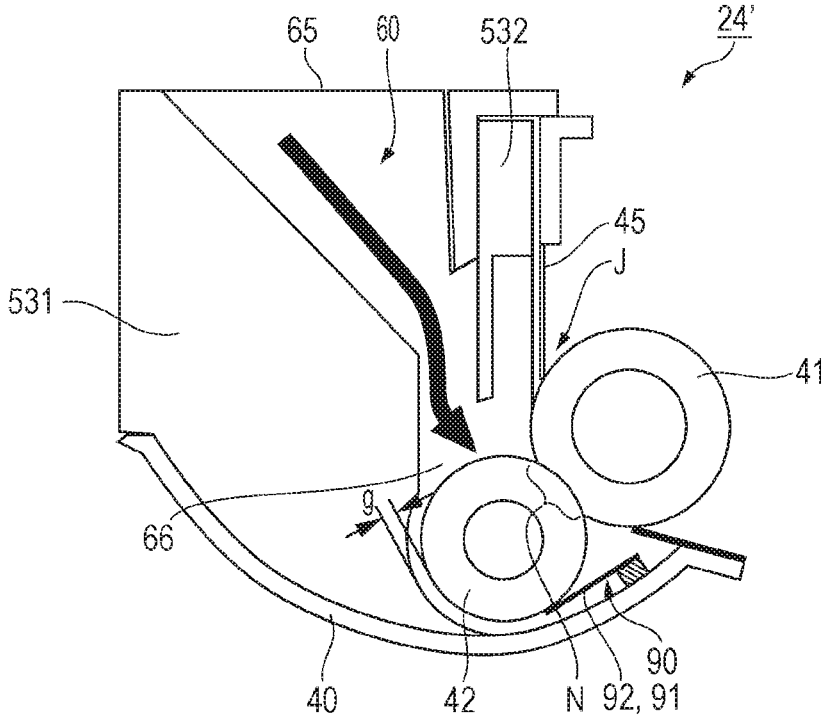
FIG. 16B RELATED ART
FIG. 16B illustrates a part of a developing device according to comparative exemplary embodiment 7.

In a developing device 24' according to comparative exemplary embodiment 7-1, when the new toner is supplied through the toner transport path 61 of the toner supplying mechanism 60, there is a risk that the new toner will be directly supplied from the developing-chamber-side opening 66 to a contact region N between the developing roller 41 and the feeding roller 42 and a contact region J between the developing roller 41 and the charging blade 45, as illustrated in FIG. 16B.

The contact regions N and J are regions in which toner exchange occurs and the toner fluidity is high. Therefore, according to comparative exemplary embodiment 7-1, mixing of the new toner and old toner is accelerated and a fogging phenomenon due to mixing of the new toner and old toner that have different electrification characteristics easily occurs.

Although the gap g is provided between the partition member 531 and the feeding roller 42, when the new toner is supplied in the direction of gravity, the new toner easily enters the gap g. Accordingly, the new toner is easily mixed with the old toner captured by the feeding roller 42.

In contrast, according to the present exemplary embodiment, the gap g between the partition member 531 and the feeding roller 42 is covered by the sealing member 171. Therefore, even when the new toner is supplied in the direction of gravity, the new toner is prevented from directly entering the gap g.

The sealing member 172 covers the gap between the feeding roller 42 and the partition member 532 located downstream of the developing-chamber-side opening 66 in the rotation direction of the feeding roller 42. Therefore, the new toner is prevented from being directly supplied from the developing-chamber-side opening 66 to the contact region N between the developing roller 41 and the feeding roller 42 and a contact region J between the developing roller 41 and the charging blade 45. Thus, the new toner and the old toner are prevented from being unnecessarily mixed.

EXAMPLES

Example 1

A developing device according to Example 1 is obtained by simplifying the structure of the toner supplying mechanism 60 (which includes the toner transport path 61 that retains new toner) in the developing device 24 according to the first exemplary embodiment.

Figure 17:
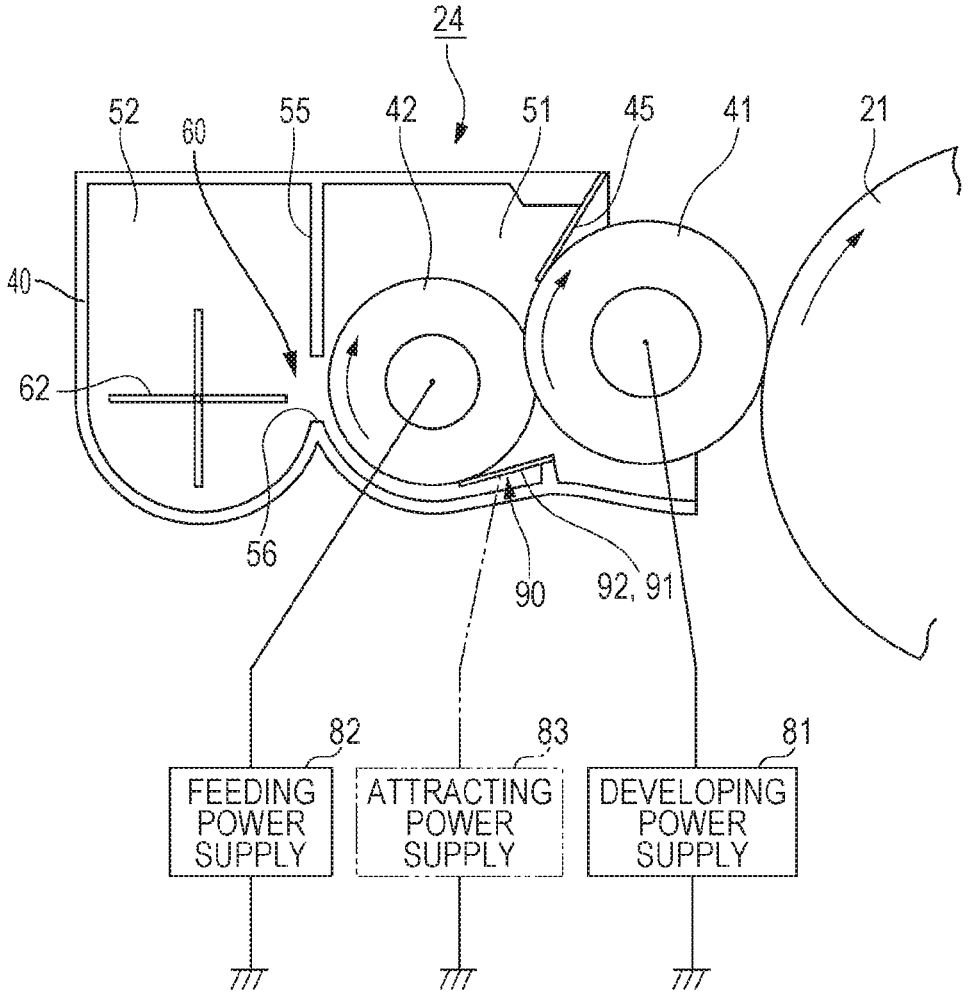
FIG. 17 illustrates the structures of developing devices according to Examples 1 and 2.

More specifically, referring to FIG. 17, a developing device 24 according to Example 1 includes a developing container 40 which is divided into a developing chamber 51 and a containing chamber 52 with a separating wall 55. The separating wall 55 has a toner transporting hole 56 that serves as a toner transport path of a toner supplying mechanism 60 and that is arranged so as to face the peripheral surface of the feeding roller 42. The width of the toner transporting hole 56 in the rotation direction of the feeding roller 42 is smaller than the outer diameter of the feeding roller 42 in a plane of projection from the feeding roller 42. A developing roller 41, the feeding roller 42, a charging blade 45, and an attaching mechanism 90 including a cantilever-type elastic sheet 92 as a guide member 91, which are similar to those of the first exemplary embodiment, are arranged in the developing chamber 51. A paddle-type agitator that serves as the toner supplying mechanism 60 is arranged in the containing chamber 52. A developing power supply 81 and a feeding power supply 82 shown in FIG. 17 are similar to those in the first exemplary embodiment.

The manner in which new toner and old toner are captured on the peripheral surface of the feeding roller 42 in the developing device 24 of Example 1 is evaluated while changing an amount of deformation of the elastic sheet 92 into the feeding roller 42.

Conditions of components of Example 1 are as follows.

Developing roller: ϕ12-mm roller which includes a ϕ5-mm shaft (shaft portion) and a silicone rubber layer provided around the shaft and which has a surface roughness Ra of 1.2 μm.

Feeding Roller: ϕ11-mm roller which includes a ϕ5-mm shaft and a urethane foam sponge rubber layer provided around the shaft and which has an average cell diameter of 300 μm and an Asker C hardness of 20.

Applied Voltages (Developing Voltage and Feeding Voltage): DC-160V for each of the developing roller and the feeding roller.

Charging Blade: Stainless steel blade having a thickness of 0.08 mm and a linear load of 40 mN/mm (≈4 gf/mm).

Elastic Sheet: Thermoplastic polyurethane sheet having a thickness of 180 μm.

Toner: Negatively-charged toner having an average particle diameter of 6.5 μm formed by emulsion polymerization.

Toners of two colors are successively used and variation in color mixture ratio caused by variation in the amount of deformation of the elastic sheet is evaluated. The color mixture ratio is determined as follows. That is, first, the developing chamber of the developing container is filled with magenta (M) toner and an idle operation is performed until a steady state is established. Then, the containing chamber is filled with cyan (C) toner. Assuming that the cyan toner does not mix into the magenta toner unless the magenta toner in the developing chamber is consumed, 20 sheets of paper are continuously subjected to a blank printing operation, and an average mixture ratio of 18th to 20th sheets is calculated. A color phase based on the L*a*b* color system or the Munsell color system is measured for each output image. The color phase obtained when the color mixture ratio of magenta and cyan is varied is measured in advance, so that the relationship between the color mixture ratio of magenta and cyan and the color phase is determined. The color mixture ratio is determined from the color phase of each of the actually output images. Values of brightness and color saturation may, of course, also be taken into consideration in addition to the color phase.

The relationship between the amount of deformation of the elastic sheet and the color mixture ratio is obtained by repeating the above-described measurement while varying the amount of deformation.

Figure 18A:
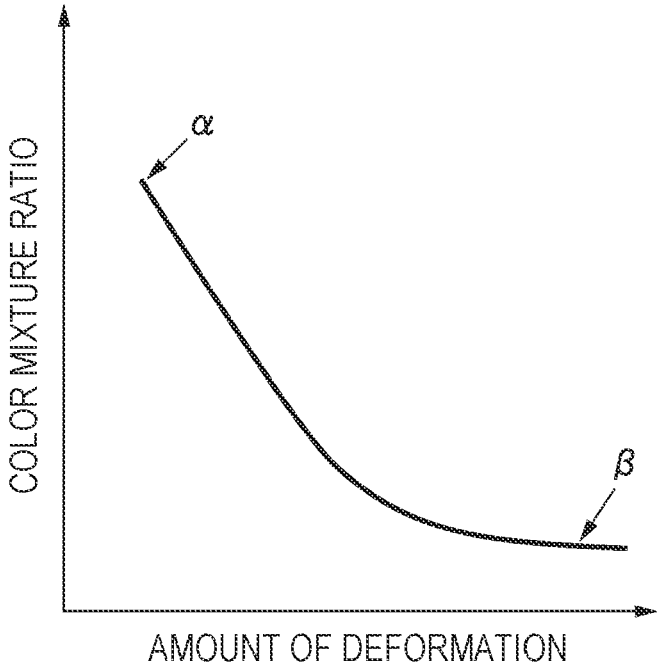
FIG. 18A is a graph showing the relationship between the amount of deformation of an elastic sheet and a color mixture ratio between new toner and old toner according to Example 1.

FIG. 18A shows the result of the measurement.

Referring to FIG. 18A, when the amount of deformation of the elastic sheet into the feeding roller is gradually increased, the color mixture ratio substantially linearly decreases and then gradually converges to a certain value. A high color mixture ratio means that a large amount of cyan toner, which corresponds to the new toner, is used in the developing process. When the amount of deformation of the elastic sheet is substantially zero (point shown by α in FIG. 18A), the contact force applied to the feeding roller by the elastic sheet is not sufficient. Therefore, a sufficient amount of magenta toner cannot be attached to the feeding roller or the magenta toner cannot be appropriately leveled. As a result, the surface of the feeding roller has many regions in which the magenta toner, which corresponds to the old toner, is not captured when the surface of the feeding roller reaches a new-toner supply region (region in which cyan toner is supplied). Accordingly, a large amount of cyan toner, which corresponds to the new toner, is supplied and attached to the surface of the feeding roller in the new-toner supply region. As a result, a large amount of cyan toner is used to form the output image, and the color mixture ratio increases.

When the amount of deformation of the elastic sheet into the feeding roller is increased, the elastic sheet of the attaching mechanism attaches a sufficient amount of magenta toner, which corresponds to the old toner, to the feeding roller and appropriately levels the magenta toner. In this case, the amount of cyan toner, which corresponds to the new toner, supplied to the surface of the feeding roller in the new-toner supply region is smaller than that in the case where the amount of deformation of the elastic sheet is small. As a result, the amount of cyan toner, which corresponds to the new toner, used to form the output image is reduced, and the color mixture ratio is reduced accordingly. The point shown by β in FIG. 18A corresponds to the case where the amount of deformation of the elastic sheet is about 1 mm.

It is clear from the above-described result that the old-toner attaching operation may be effectively performed by the attaching mechanism when the amount of deformation of the elastic sheet into the feeding roller is greater than or equal to a certain value. In this case, the old toner may be preferentially consumed and the amount of supply of the new toner may be reduced. As a result, excessive consumption of the new toner is suppressed.

Example 2

A developing device according to Example 2 is similar to the developing device according to Example 1 illustrated in FIG. 17 except that the developing device includes an attaching mechanism according to the third exemplary embodiment which generates an attractive electric field. The manner in which the new toner and the old toner are captured on the peripheral surface of the feeding roller 42 is evaluated while changing the potential difference between the elastic sheet 92 and the feeding roller 42. Referring to FIG. 17, an attracting power supply 83 for the elastic sheet 92 is provided in Example 2.

Conditions of components of Example 2 are as follows.

Developing roller: ϕ12-mm roller which includes a ϕ5-mm shaft (shaft portion) and a silicone rubber layer provided around the shaft and which has a surface roughness Ra of 1.2 μm.

Feeding Roller: ϕ11-mm roller which includes a ϕ5-mm shaft and a urethane foam sponge rubber layer provided around the shaft and which has an average cell diameter of 300 μm and an Asker C hardness of 20.

Applied Voltages (Developing Voltage and Feeding Voltage): DC-160V for each of the developing roller and the feeding roller.

Charging Blade: Stainless steel blade having a thickness of 0.08 mm and a linear load of 40 mN/mm (≈4 gf/mm).

Elastic Sheet: Polyimide sheet having a thickness of 200 μm and a volume resistivity of $1.6\times10^{6}$ Ω·cm.

Amount of deformation of Elastic Sheet into Feeding Roller: 1 mm.

Bias Voltage Applied to Elastic Sheet: Voltage with the positive side at the feeding roller.

Toner: Negatively-charged toner having an average particle diameter of 6.5 μm formed by emulsion polymerization.

Similar to Example 1, toners of two colors are successively used and variation in the color mixture ratio caused by variation in the potential difference between the elastic sheet and the feeding roller is evaluated.

Figure 18B:
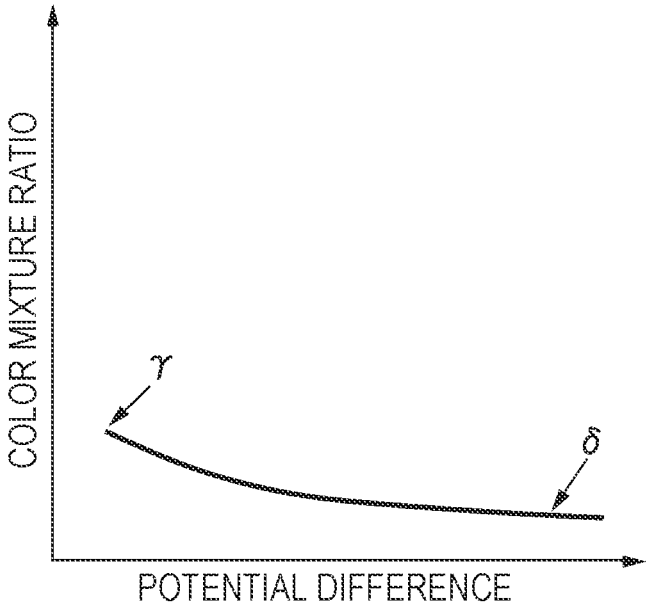
FIG. 18B is a graph showing the relationship between a potential difference between an elastic sheet and a feeding roller and a color mixture ratio between new toner and old toner according to Example 2.

FIG. 18B shows the result of the measurement.

Referring to the measurement result shown in FIG. 18B, when the potential difference between the elastic sheet and the feeding roller is increased from zero (point shown by γ in FIG. 18B), the color mixture ratio gradually decreases so as to converge to a certain value.

When the potential difference is applied between the elastic sheet and the feeding roller such that the feeding roller is at the positive side, the magenta toner, which corresponds to the old toner, on the elastic sheet receives a force that electrostatically attracts the magenta toner to the feeding roller. Accordingly, the magenta toner on the elastic sheet may be easily attached to the feeding roller. In addition, the elastic sheet levels the magenta toner, so that the amount of cyan toner, which corresponds to the new toner, supplied in the new-toner supply region is reduced and the color mixture ratio is reduced accordingly. The color mixture ratio is also small when the potential difference is zero (point shown by γ in FIG. 18B) because the amount of deformation of the elastic sheet into the feeding roller is set to about 1 mm in Example 2.

In Example 2, toner aggregation occurs when the potential difference between the elastic sheet and the feeding roller is excessively increased (for example, to 600 V or more). This is because electric discharge occurs between the elastic sheet and the feeding roller when the potential difference is too large. When a potential difference is provided between the elastic sheet and the feeding roller, it is necessary to prevent an excessive potential difference from being applied between the elastic sheet and the feeding roller in consideration of a resistance between the elastic sheet and the feeding roller and the amount of deformation of the elastic sheet into the feeding roller.

The influence of the potential difference is further evaluated by the present inventors by using elastic sheets having different volume resistivities. As a result, the potential difference may be set to about 300 V (point shown by δ in FIG. 18B) when the volume resistivity of the elastic sheet is $10^6$ to $10^8$ Ω·cm.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a transporting unit that rotates while facing an image carrier that rotates while carrying an electrostatic latent image, the transporting unit transporting developer toward the image carrier so that the electrostatic latent image on the image carrier is developed;

a feeding unit having a peripheral surface that rotates and to which the developer is attached, the feeding unit contacting the transporting unit to feed the developer to the transporting unit;

a transport path that connects a containing chamber that contains the developer to a feeding chamber that houses the feeding unit;

a supplying unit that retains the developer to be supplied to the feeding unit in the transport path and supplies the developer to the feeding unit in a supply region that is separated from a contact region in which the feeding unit contacts the transporting unit; and an attaching unit that is disposed downstream of the contact region and upstream of the supply region in a rotation direction of the feeding unit and that attaches the developer to the feeding unit with an elastic force at a location below the contact region.

2. The developing device according to claim 1, wherein the attaching unit includes an elastically deformable plate-shaped member, and wherein the plate-shaped member is inclined so that a downstream portion of the plate-shaped member in the rotation direction of the feeding unit is below an upstream portion of the plate-shaped member in the rotation direction of the feeding unit.

3. The developing device according to claim 2, wherein the plate-shaped member has a smooth surface along which particles of the developer are capable of rolling in a direction of inclination of the plate-shaped member.

4. The developing device according to claim 1, wherein the transporting unit and the feeding unit rotate so that opposing portions of the transporting unit and the feeding unit move in different directions.

5. The developing device according to claim 1, wherein the attaching unit includes a conductive member, and wherein the developing device further comprises an attractive-electric-field forming unit that forms an attractive electric field between the attracting unit and the feeding unit, the attractive electric field being capable of attracting the developer to the feeding unit.

6. The developing device according to claim 1, wherein a contact force applied to the feeding unit by the attaching unit is smaller than a contact force applied between the feeding unit and the transporting unit in the contact region.

7. The developing device according to claim 1, wherein the supplying unit is configured to connect the containing chamber to a developing chamber with the transport path, the containing chamber containing new developer such that the new developer is capable of being supplied and the developing chamber housing the feeding unit and the transporting unit, and wherein a developing-chamber-side opening of the transport path faces the feeding unit and is disposed below a containing-chamber-side opening of the transport path.

8. An image forming apparatus comprising:

an image carrier that rotates while carrying an electrostatic latent image; and eloping device according to claim 1, the developing device facing the image carrier and developing the electrostatic latent image on the image carrier.

9. The image forming apparatus according to claim 8, further comprising:

a control device capable of controlling a developer consumption of the developing device, wherein the control device includes a calculating unit that calculates an amount of developer consumption when an amount of image formation reaches a predetermined amount, a determining unit that determines whether or not the amount of developer consumption calculated by the calculating unit is greater than or equal to a predetermined threshold, an ejecting unit that ejects a predetermined amount of the developer contained in the developing device toward the image carrier when it is determined by the determining unit that the amount of developer consumption is less than the threshold, and a cleaning process unit that removes the developer that has been ejected to the image carrier by the ejecting unit.

* * * * *